US006479227B1

(12) United States Patent
Kubo et al.

(10) Patent No.: US 6,479,227 B1
(45) Date of Patent: Nov. 12, 2002

(54) THERMOGRAPHIC RECORDING ELEMENTS

(75) Inventors: Toshiaki Kubo, Kanagawa; Naohiro Nakayama, Saitama, both of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/245,417

(22) Filed: Feb. 5, 1999

(30) Foreign Application Priority Data

Feb. 6, 1998 (JP) ..... 10-041302

(51) Int. Cl.[7] ..... G03C 1/498; G03C 1/32

(52) U.S. Cl. ..... 430/523; 430/527; 430/530; 430/531; 430/617; 430/619; 430/950

(58) Field of Search ..... 430/523, 527, 430/530, 617, 619, 950, 531

(56) References Cited

U.S. PATENT DOCUMENTS 5,545,515 A * 8/1996 Murray et al. ..... 430/619
5,575,957 A 11/1996 Okuda et al.
5,719,016 A 2/1998 Christian et al.
6,060,228 A * 5/2000 Suzuki ..... 430/522
6,074,807 A * 6/2000 Eichorst et al. ..... 430/529

* cited by examiner

*Primary Examiner*—Thorl Chea
(74) *Attorney, Agent, or Firm*—Birch, Stewart, Kolasch & Birch, LLP

(57) ABSTRACT

A thermographic recording element comprising a thermographic recording layer containing an organic silver salt and a reducing agent on a support is provided with an antistatic layer containing acicular conductive metal oxide particles having an aspect ratio of from 3 to 50. In another embodiment, the element is provided with at least two back layers, the outermost layer of which contains a hydrophobic polymer binder and another layer of which contains a matte agent. The element has improved transparency, conductivity and high-speed processing adaptability.

16 Claims, No Drawings

THERMOGRAPHIC RECORDING ELEMENTS

This invention relates to thermographic recording elements having an antistatic layer or a matte agent-containing layer.

BACKGROUND OF THE INVENTION

From the contemporary standpoints of environmental protection and space saving, it is strongly desired in the photomechanical process field to reduce the quantity of spent solution. Needed in this regard is a technology relating to photothermographic elements for use in reprophotography which can be effectively exposed by means of laser image setters and produce distinct black images having high resolution and sharpness. These photothermographic elements offer to the customer a simple thermographic system which eliminates a need for solution type chemical agents and is not detrimental to the environment.

Photothermographic elements which form photographic images through heat development are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., item 2, 1969.

Thermographic recording elements based on this system are expected to find use in a variety of fields because of their advantages of mono-sheet construction and possible image formation solely by heat treatment.

These chemical-free recording elements (which do not use developers, fixers and other solutions) are more frequently used at relatively low temperature, and thus require a more strict countermeasure for static electricity than conventional photographic silver halide photosensitive materials. If the antistatic countermeasure is insufficient, electrostatic discharge can occur during transportation of recording elements and black pepper-like spots be generated in unexposed areas. Also, since steps from exposure to development are carried out as a single process, the elements are more frequently transported at a high speed. There is a demand for more efficient transportation.

One electrostatic countermeasure known in the art is to provide recording elements with antistatic layers containing conductive polymers, ionic or nonionic surfactants, colloidal silica, metal oxides or compound oxides. Of these, fine particles of metal oxides or compound oxides optionally containing minor amounts of hetero atoms are preferred antistatic agents. Antistatic layers containing such particles are disclosed in JP-B 20736/198, JP-A 20033/1986 and JP-A 39651/1992.

In order to impart sufficient electric conduction to thermographic recording elements, however, these antistatic agents must be added in large amounts at the sacrifice of transparency of the elements. Since the loss of transparency causes to reduce the commercial value of recording elements, there is a demand for an element which is improved in transparency while maintaining conductivity.

As to transportation, it is known in the art to add matte agents to improve transportation. When the above-mentioned antistatic countermeasure is taken, there is a possibility that conductive particles and matte agent fall off due to dynamic contact with the conveyor members during transportation. Especially because the exposure time is reduced by the recent advance of the exposure technology, it is desired to perform the overall process at a higher speed. As the transportation speed and processing speed increase, the fall-off problem becomes serious. An improvement in this regard is desired.

SUMMARY OF THE INVENTION

An object of the present invention is to provide a thermographic recording element which is improved in transparency while maintaining conductivity.

Another object of the present invention is to provide a thermographic recording element which is adapted for high-speed processing.

A further object of the present invention is to provide a thermographic recording element having improved transparency, conductivity and high-speed processing adaptability.

In one aspect of the invention, there is provided a thermographic recording element comprising on a support at least one antistatic layer containing conductive metal oxide particles and at least one thermographic recording layer containing an organic silver salt and a reducing agent. The conductive metal oxide particles are acicular particles having a major axis to minor axis ratio of from 3/1 to 50/1.

Preferably, the conductive metal oxide particles are particles of at least one type selected from among ZnO, $TiO_2$, $SnO_2$, $Al_2O_3$, $In_2O_3$, MgO, and compound oxides thereof, which may further contain a hetero atom. More preferably, the conductive metal oxide particles are particles of $SnO_2$ doped with antimony.

One preferred embodiment is a one-side thermographic recording element having the thermographic recording layer only on one surface of the support. The thermographic recording element further has at least two back layers on the opposite surface of the support. The outermost layer of the back layers contains a hydrophobic polymer binder and at least one layer of the back layers other than the outermost layer contains a matte agent.

In another aspect of the invention, there is provided a thermographic recording element comprising a support having a pair of opposed surfaces, at least one thermographic recording layer containing an organic silver salt and a reducing agent on one surface of the support, and at least two layers on the other surface of the support. The outermost layer of the at least two layers contains a hydrophobic polymer binder and at least one layer of the at least two layers other than the outermost layer contains a matte agent.

Preferably, the outermost layer is based on a binder containing at least 75% by weight of a water-dispersible polymer latex, and has a thickness of 0.2 to 10 $\mu$m.

DETAILED DESCRIPTION OF THE INVENTION

The thermographic recording element of the invention has a thermographic recording layer containing an organic silver salt and a reducing agent. One preferred embodiment of the invention is a one-side thermographic recording element having a thermographic recording layer only on one surface of a support. In the thermographic recording element of the preferred embodiment, an antistatic layer is provided on the back surface of the support opposite to the thermographic recording layer. The antistatic layer contains acicular conductive metal oxide particles having an aspect ratio of from 3 to 50. The use of such acicular conductive metal oxide particles as the antistatic agent is effective for suppressing the generation of black spots by static electricity and thus improving transparency and increasing the commodity value. In contrast, spherical conductive metal oxide particles are difficult to meet both the requirements of suppression of black spot generation and transparency, and when added in a large amount sufficient to suppress black spot generation, will detract from transparency. The aspect ratio is limited to the range of from 3 to 50 because the acicular shape effect is lost with an aspect ratio of less than 3 and particles with an aspect ratio of more than 50 are impractical.

In another preferred embodiment of the invention, a one-side thermographic recording element has at least two back layers on the back surface of the support. The outermost layer of the back layers contains a hydrophobic polymer as the binder and at least one layer of the back layers other than the outermost layer contains a matte agent. This construction is effective for improving mar resistance and preventing particles from peeling off even during high-speed transportation. These effects become outstanding particularly with the embodiment having the above-described antistatic layer. To prevent antistatic agent particles from falling off, it is preferred that the layer of the back layers other than the outermost layer, for example, the matte agent-containing layer be an antistatic layer. If the matte agent is added to the outermost layer, matte agent particles will fall off during transportation and the element becomes practically unacceptable. If a hydrophilic polymer such as gelatin rather than the hydrophobic polymer is used in the outermost layer, that layer loses film strength.

The conductive metal oxide particles used herein are acicular particles having an aspect ratio of from 3/1 to 50/1, especially from 10/1 to 50/1. Provided that an acicular particle has a major axis or length and a minor axis or breadth, the aspect ratio is defined as the major axis divided by the minor axis. These acicular particles preferably have a minor axis or breadth in the range of 0.001 to 0.1 $\mu$m, especially 0.01 to 0.02 $\mu$m and a major axis or length in the range of 0.1 to 5.0 $\mu$m, especially 0.1 to 2.0 $\mu$m.

Examples of the conductive metal oxide particles include ZnO, $TiO_2$, $SnO_2$, $Al_2O_3$, $In_2O_3$, MgO, BaO, and $MoO_3$, and compound oxides thereof, which may contain a hetero atom. Preferred metal oxides are $SnO_2$, ZnO, $Al_2O_3$, $TiO_2$, $In_2O_3$, and MgO, more preferably $SnO_2$, ZnO, $In_2O_3$, and $TiO_2$, with $SnO_2$ being most preferred. Examples of the metal oxide containing a minor amount of a hetero atom are ZnO containing Al or In, $TiO_2$ containing Nb or Ta, $In_2O_3$ containing Sn, and $SnO_2$ containing Sb, Nb or halogen atom wherein the metal oxide is doped with 0.01 to 30 mol %, preferably 0.1 to 10 mol % of the hetero atom. Less than 0.01 mol % of the hetero atom would be too small to impart sufficient conductivity to oxide or compound oxide whereas more than 30 mol % of the hetero atom would increase the degree of blackening of particles so that the antistatic layer becomes blackened and unsuitable for the image recording use. Accordingly, metal oxides and compound metal oxides containing a minor amount of hetero atom are preferred as the conductive metal oxide particles. They may have oxygen defects in their crystal structure.

Preferred as the conductive metal oxide particles containing a minor amount of hetero atom are $SnO_2$ particles doped with antimony, especially $SnO_2$ particles doped with 0.2 to 2.0 mol % of antimony.

Accordingly, metal oxide particles having minor and major axis dimensions within the above-defined range, typically tin oxide particles doped with antimony are advantageous in forming a transparent antistatic layer having good conductivity.

By the use of acicular metal oxide particles having specific minor and major axis dimensions, typically $SnO_2$ particles doped with antimony, a transparent, highly conductive, antistatic layer is obtained for the following reason. The acicular metal oxide particles are contained in the antistatic layer such that their major axis extends parallel to the surface of the layer and over a substantial length while their minor axis occupies only a fraction of the thickness of the layer. Since the acicular metal oxide particles are, of course, longer in the major axis direction, they are likely to contact with each other as compared with ordinary spherical particles, so that a higher conductivity is obtained even with a less loading. Therefore, the acicular metal oxide particles succeed in reducing the surface electrical resistivity of the layer without detracting from transparency.

Moreover, since the minor axis or breadth is generally at most equal to the thickness of the antistatic layer, the acicular metal oxide particles do not protrude beyond the surface of the layer and even when protrude, the protrusion is small enough to be fully covered with a surface layer to be formed over the antistatic layer. This leads to the superiority that no dusting or separation of such protrusions from the layer occurs during transportation of the support for the manufacture of the recording element or during transportation of the recording element for exposure and development.

The antistatic layer used herein is preferably a layer containing a polymer latex in an amount of at least 30% by weight of the entire binder. The "polymer latex" is a dispersion of water-insoluble hydrophobic polymer microparticulates in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear, branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low mechanical strength as the binder whereas polymers with a too higher molecular weight are difficult to form films.

Illustrative examples of the polymer latex which can be used as the binder in the antistatic layer of the thermographic element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.), Nipol Lx811, 814, 820, 821, and 857 (Nippon Zeon K.K.), and Jurimer ET-410 (Nippon Junyaku K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 (Dai-Nippon Ink & Chemicals K.K.). Exemplary rubbery resins are LACSTAR 7310K, 3307B, 4700H, and 7132C (Dai-Nippon Ink & Chemicals K.K.) and Nipol Lx416, 410, 438C, and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the antistatic layer according to the invention, a hydrophilic polymer may be added in an amount of up to 70% by weight, preferably up to 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose.

To the antistatic layer according to the invention, a crosslinking agent is added if necessary. The addition of crosslinking agents is preferred. The crosslinking agents may be used alone or in admixture of two or more.

Illustrative, non-limiting examples of the crosslinking agent include melamine compounds and derivatives thereof such as dimethylol melamine, trimethylol melamine, tetramethylol melamine, pentamethylol melamine, hexamethylol melamine, hexamethylol melamine resin, trimethyol melamine resin, and trimethylol trimethoxymethylmelamine resin; aldehydes and derivatives thereof such as mucochloric acid, mucobromic acid, mucophenoxychloric acid, mucophenoxybromic acid, formaldehyde, glyoxazole, monomethylglyoxazole, 2,3-dihydroxy-1,4-dioxane, 2,3-dihydroxy-5-methyl-1,4-dioxane, succinaldehyde, 2,5-dimethoxytetrahydrofuran, and glutaraldehyde; active vinyl compounds such as divinylsulfone-N,N'-ethylenebis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, and 1,3,5-trivinylsulfonyl-hexahydro-s-triazine; active halides such as the sodium salt of 2,4-dichloro-6-hydroxy-s-triazine, the sodium salt of 2,4-dichloro-6-(4-sulfoanilino)-s-triazine, 2,4-dichloro-6-(2-sulfoethylamino)-s-triazine, and N,N'-bis(2-chloroethylcarbamyl)piperadine; epoxy compounds such as bis(2,3-epoxypropyl)methylpropyl ammonium p-toluenesulfonate salt, 1,4-bis(2',3'-epoxypropyloxy)butane, 1,3,5-triglycidyl isocyanurate, and 1,3-diglycidyl-5-(γ-acetoxy-β-oxypropyl) isocyanurate, sorbitol polyglycidyl ethers, polyglycerol polyglycidyl ethers, pentaerythritol polyglycidyl ethers, diglycerol polyglycidyl ether, 1,3,5-triglycidyl(2-hydroxyethyl)isocyanurate, glycerol polyglycerol ethers, and trimethylolpropane polyglycidyl ethers; ethyleneimine compounds such as 2,4,6-triethylene-s-triazine, 1,6-hexamethylene-N,N'-bisethylene urea, and bis-β-ethyleneiminoethyl thioether; methanesulfonic acid esters such as 1,2-di(methanesulfonoxy)ethane, 1,4-di(methanesulfonoxy)butane, and 1,5-di(methanesulfonoxy)-pentane; carbodiimide compounds such as dicyclohexylcarbodiimide and 1-dicyclohexyl-3-(3-trimethylaminopropyl) carbodiimide hydrochloride; isoxazole compounds such as 2,5-dimethylisoxazole; inorganic compounds such as chromium alum and chromium acetate; dehydration condensation type peptide reagents such as N-carboethoxy-2-isopropoxy-1,2-dihydroquinoline and N-(1-morpholinocarboxy)-4-methylpyridinium chloride; active ester compounds such as N,N'-adipoyldioxydisuccinimide and N,N'-terephthaloyldioxydisuccinimide; isocyanates such as toluene-2,4-diisocyanate and 1,6-hexamethylene diisocyanate; and epichlorohydrin compounds such as polyamide-polyamine-epichlorohydrin reaction products. These compounds are added in amounts of 1 to 100%, preferably 5 to 80% by weight of the binder.

To the antistatic layer according to the invention, a surfactant may be added for the ease of application.

As the surfactant, any of nonionic, anionic, cationic and fluorochemical surfactants may be used. Examples include fluorochemical polymer surfactants as described in JP-A 170950/1987 and U.S. Pat. No. 5,380,644, fluorochemical surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Furthermore, the antistatic layer according to the invention may contain a dye. The dyes used in the antistatic layer are preferably of the following formula (D).

(D)

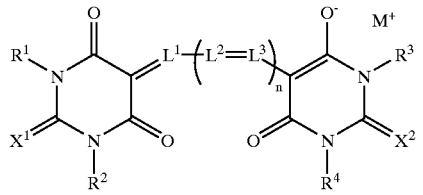

$R^1$, $R^2$, $R^3$, and $R^4$ each are hydrogen or an aliphatic, aromatic or heterocyclic group, $X^1$ and $X^2$ each are an oxygen or sulfur atom, $L^1$, $L^2$, and $L^3$ each are a methine group, letter n is equal to 0, 1, 2 or 3, and $M^+$ is a hydrogen atom or an inorganic or organic cation, with the proviso that $R^1$, $R^2$, $R^3$, $R^4$, $L^1$, $L^2$, and $L^3$ are free of groups having ionizable proton or salts thereof, and at least one of $L^1$, $L^2$, and $L^3$ has a substituent in case of n=2.

The maximum absorption wavelength λmax (nm) of the dye of formula (D) in the recording element or antistatic layer should satisfy the relationship represented by the formula (F):

$$\lambda max > \{\lambda max(DMF) + 20 \times (n+1)\} \quad (F)$$

wherein λmax(DMF) is the maximum absorption wavelength (nm) of the dye in a dimethylformamide solution and n is as defined in formula (D). Note that the λmax of the dye in the recording element can be measured using a coated sample obtained by coating a support with a dye layer under the same conditions as in the preparation of the recording element.

The dyes of formula (D) are described in detail. The aliphatic groups represented by $R^1$, $R^2$, $R^3$, and $R^4$ include straight, branched or cyclic alkyl, aralkyl and alkenyl groups of 1 to 10 carbon atoms, for example, methyl, ethyl, propyl, n-butyl, sec-butyl, t-butyl, isobutyl, n-pentyl, n-hexyl, n-heptyl, n-octyl, cyclohexyl, 2-ethylhexyl, 3-methylbutyl, cyclopentyl, 2-ethylbutyl, vinyl, allyl, and 1-propenyl. These groups may have substituents which include nitro groups, amino groups of 0 to 6 carbon atoms (such as unsubstituted amino, dimethylamino, and diethylamino), aryl groups of 6 to 10 carbon atoms (such as phenyl and 2-chlorophenyl), alkylthio groups of 1 to 8 carbon atoms (such as methylthio and ethylthio), carbonamide groups of 2 to 8 carbon atoms (such as acetylamino and propionylamino), oxycarbonylamino groups of 2 to 8 carbon atoms (such as methoxycarbonylamino and n-butoxycarbonylamino), carbamoyl groups of 2 to 8 carbon atoms (such as dimethylcarbamoyl and diethylcarbamoyl), and acyl groups of 2 to 8 carbon atoms (such as acetyl and propionyl).

The aromatic groups represented by $R^1$, $R^2$, $R^3$, and $R^4$ are preferably phenyl and naphthyl, more preferably phenyl. These groups may be substituted ones. In addition to the above-listed substituents that the alkyl groups represented by $R^1$, $R^2$, $R^3$, and $R^4$ may have, the substituents include alkyl groups of 1 to 4 carbon atoms (such as methyl, ethyl, n-propyl and t-butyl), halogen atoms (such as F, Cl and Br), cyano groups, alkoxy groups of 1 to 8 carbon atoms (such as methoxy, ethoxy, propoxy and phenoxy), ester groups of 2 to 8 carbon atoms (such as methoxycarbonyl and ethoxycarbonyl), and alkylsulfonyl groups of 1 to 8 carbon atoms (such as methanesulfonyl and ethanesulfonyl).

The heterocyclic groups represented by $R^1$, $R^2$, $R^3$, and $R^4$ are preferably 5- or 6-membered heterocycles containing nitrogen, oxygen or sulfur as the hetero atom, for example, pyridyl, pyrazinyl, imidazolyl, furyl, thienyl, pyrrole, indolyl, morpholyl, pyrrolidyl, and tetrazolyl. These heterocyclic groups may have the above-listed substituents that the aromatic groups represented by $R^1$, $R^2$, $R^3$, and $R^4$ may have.

$M^+$ is preferably H, Li, Na, K, Ca, triethylammonium or pyridinium.

In case of n=0 or 1, the methine groups represented by $L^1$, $L^2$, and $L^3$ may be unsubstituted or have substituents such as methyl, ethyl, benzyl, phenyl, chloro, amino, piperidino and morpholino. In case of n=2, at least one of the methine groups represented by $L^1$, $L^2$, and $L^3$ should have substituent or substituents such as methyl, ethyl, benzyl, phenyl, phenoxy, benzoyl, chloro, amino, piperidino, morpholino, hydroxy and dimethylcarbamoyl, and the methine groups may be joined together to form a 5- or 6-membered ring such as a cyclopentene, cyclohexene, 1-chlorocyclopentene, 1-chlorocyclohexene, 1-dimethylamino-cyclopentene or 1-morpholinocyclopentene ring.

Letter n is preferably equal to 0, 1 or 2, and most preferably equal to 2. $X^1$ and $X^2$ are preferably oxygen atoms.

In the antistatic layer according to the invention, a variety of dyes and pigments may be used in combination with the above-described dyes. Any desired dyes and pigments may be used in combination. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3–6 to 3–18 and 3–23 to 3–38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2–10 to 2–11 described in JP-A 165147/1993), and azo dyes (e.g., Compounds 10 to 16 described in JP-A 341441/1993). Other useful dyes are described in JP-A 56458/1984, 216140/1990, 13295/1995, 11432/1995, USP 5,380,635, JP-A 68539/1990, page 13, lower-left column, line 1 to page 14, lower-left column, line 9, and JP-A 24539/1991, page 14, lower-left column to page 16, lower-right column. Useful dyes which will decolorize during processing are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049. The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 μg to 1 g per square meter of the element.

In one preferred embodiment of the invention, the thermographic recording element having the antistatic layer further has at least one protective layer on the surface of the antistatic layer remote from the support. The protective layer in this embodiment should contain the above-defined polymer latex in an amount of at least 50%, preferably at least 70%, more preferably at least 75% by weight of the entire binder. This does not apply where the antistatic layer is interposed between the thermographic recording layer and the support.

In the practice of the invention, the antistatic layer and a protective layer therefor each are preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Beside water, exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio.

In the practice of the invention, a matte agent may be added to the antistatic layer for improving transportation. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium ioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a mean particle size of 0.1 $\mu$m to 30 $\mu$m are preferably used in the practice of the invention. The particle size distribution of the matte agent may be either narrow or wide. Nevertheless, since the haze and surface luster of coating are largely affected by the matte agent, it is preferred to adjust the particle size, shape and particle size distribution of a matte agent as desired during preparation of the matte agent or by mixing plural matte agents.

The matte agent may be added to a layer other than the antistatic layer. For the purpose of preventing matte agent particles from falling off, it is preferred that the matte agent be added to a layer located on the opposite side of the support to the thermographic recording layer and other than the outermost layer, which layer is referred to as a back layer, hereinafter.

In the practice of the invention, the back layer should preferably have a degree of matte as expressed by a Bekk smoothness of 1 to 2,000 seconds, more preferably 10 to 1,000 seconds.

Of the back layers, at least the outermost layer should preferably be a layer containing 50% by weight based on the entire binder of a polymer latex. The "polymer latex" used herein is as defined above in conjunction with the antistatic layer.

The back layer may have a multi-layer structure or a single-layer structure although the multi-layer structure is preferred in order that the back layer have multiple functions of an antistatic layer, a matte agent layer and so forth. In the case of the multi-layer structure, the outermost layer is preferably a layer based on a hydrophobic polymer, more preferably a layer based on a polymer originating from the above-described polymer latex, most preferably a layer using at least 75% by weight based on the entire binder of the polymer latex. The hydrophobic polymer used herein include polyvinyl acetal, polyvinyl chloride, polyvinyl acetate, cellulose acetate, polyolefin, polystyrene, polyacrylonitrile, and polycarbonate as well as polymers originating from the above-described polymer latexes, though not limited thereto.

In the back layer according to the invention, a hydrophilic polymer may be added in an amount of up to 70% by weight of the entire binder. Such hydrophilic polymers are gelatin, polyvinyl alcohol, methyl cellulose, hydroxypropyl cellulose, carboxymethyl cellulose, and hydroxypropyl methyl cellulose.

In the practice of the invention, the back layer is preferably formed by applying an aqueous coating solution followed by drying. The term "aqueous" has the same meaning as defined above in conjunction with the antistatic layer.

The outermost layer of the back layers should preferably have a thickness of at least 0.05 $\mu$m, more preferably about 0.2 $\mu$m to about 10 $\mu$m, in order to prevent conductive metal oxide particles and matte agent from falling off.

The overall amount of binder in the back layers is preferably in the range of 0.2 to 30 g/m$^2$, more preferably 1 to 15 g/m$^2$.

The matte agent-containing layer should preferably have a thickness of 0.03 to 1.0 $\mu$m. The antistatic layer should preferably have a thickness of 0.01 to 1.0 $\mu$m.

To the back layers according to the invention, a crosslinking agent for crosslinking, a surfactant for ease of application and other addenda may be added. Examples of these agents are the same as described above in conjunction with the antistatic layer.

Next, the organic silver salt, reducing agent and other components used in the thermographic recording element of the invention are described.

Organic Silver Salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. The silver-providing substance preferably constitutes about 5 to 70% by weight of the image forming layer (or thermographic recording layer). Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithio-carboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274, and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle or acicular crystals having a minor axis and a major axis are preferred. In the practice of the invention, grains should preferably have a minor axis of 0.01 $\mu$m to 0.20 $\mu$m and a major axis of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

For the purpose of obtaining a solid particle dispersion of an organic silver salt having a high S/N ratio and a small particle size and free of agglomeration, use is preferably made of a dispersion method involving the steps of converting a water dispersion containing an organic silver salt as an image forming medium, but substantially free of a photosensitive silver salt into a high pressure, high speed flow, and causing a pressure drop to the flow. Thereafter, the dispersion is mixed with an aqueous solution of a photosensitive silver salt, thereby preparing a photosensitive image forming medium coating solution.

When a thermographic recording element is prepared using this coating solution, the resulting thermographic recording element has a low haze, low fog and high sensitivity. In contrast, if a photosensitive silver salt is co-present when an organic silver salt is dispersed in water by converting into a high pressure, high speed flow, then there result a fog increase and a substantial sensitivity decline. If an organic solvent is used instead of water as the dispersing medium, then there result a haze increase, a fog increase and a sensitivity decline. If a conversion technique of converting a portion of an organic silver salt in a dispersion into a photosensitive silver salt is employed instead of mixing an aqueous solution of a photosensitive silver salt, then there results a sensitivity decline.

The water dispersion which is dispersed by converting into a high pressure, high speed flow should be substantially free of a photosensitive silver salt. The content of photosensitive silver salt is less than 0.1 mol % based on the non-photosensitive organic silver salt. The positive addition of photosensitive silver salt is avoided.

With respect to the solid dispersing technology and apparatus employed in carrying out the above-described dispersion method of the invention, reference should be made to Kajiuchi and Usui, "Dispersed System Rheology and Dispersing Technology," Shinzansha Publishing K.K., 1991, pp. 357–403; and Tokai Department of the Chemical Engineering Society Ed., "Progress of Chemical Engineering, Volume 24," Maki Publishing K.K., 1990, pp. 184–185. According to the dispersion method recommended above, a water dispersion liquid containing at least an organic silver salt is pressurized by a high pressure pump or the like, fed into a pipe, and passed through a narrow slit in the pipe whereupon the dispersion liquid is allowed to experience an abrupt pressure drop, thereby accomplishing fine dispersion.

Such a high pressure homogenizer which is used in the practice of the invention is generally believed to achieve dispersion into finer particles under the impetus of dispersing forces including (a) "shear forces" exerted when the dispersed phase is passed through a narrow gap under high pressure and at a high speed and (b) "cavitation forces" exerted when the dispersed phase under high pressure is released to atmospheric pressure. As the dispersing apparatus of this type, Gaulin homogenizers are known from the past. In the Gaulin homogenizer, a liquid to be dispersed fed under high pressure is converted into a high-speed flow through a narrow slit on a cylindrical surface and under that impetus, impinged against the surrounding wall surface, achieving emulsification and dispersion by the impact forces. The pressure used is generally 100 to 600 kg/cm$^2$ and the flow velocity is from several meters per second to about 30 m/sec. To increase the dispersion efficiency, improvements are made on the homogenizer as by modifying a high-flow-velocity section into a saw-shape for increasing the number of impingements. Apart from this, apparatus capable of dispersion at a higher pressure and a higher flow velocity were recently developed. Typical examples of the advanced dispersing apparatus are available under the trade name of Micro-Fluidizer (Microfluidex International Corp.) and Nanomizer (Tokushu Kika Kogyo K.K.).

Examples of appropriate dispersing apparatus which are used in the practice of the invention include Micro-Fluidizer M-110S-EH (with G10Z interaction chamber), M-110Y (with H10Z interaction chamber), M-140K (with G10Z interaction chamber), HC-5000 (with L30Z or H230Z interaction chamber), and HC-8000 (with E230Z or L30Z interaction chamber), all available from Microfluidex International Corp.

Using such apparatus, a water dispersion liquid containing at least an organic silver salt is pressurized by a high pressure pump or the like, fed into a pipe, and passed through a narrow slit in the pipe for applying a desired pressure to the liquid and thereafter, the pressure within the pipe is quickly released to atmospheric pressure whereby the dispersion liquid experiences an abrupt pressure drop, thereby accomplishing the fine dispersion effect suited for the invention.

According to the invention, the organic silver salt dispersion can be dispersed to a desired particle size by adjusting a flow velocity, a differential pressure upon pressure drop, and the number of dispersing cycles. From the standpoints of photographic properties and particle size, it is preferable to use a flow velocity of 200 to 600 m/sec and a differential pressure upon pressure drop of 900 to 3,000 kg/cm$^2$, and especially a flow velocity of 300 to 600 m/sec and a differential pressure upon pressure drop of 1,500 to 3,000 kg/cm$^2$. The number of dispersing cycles may be selected as appropriate although it is usually 1 to 10. From the productivity standpoint, the number of dispersing cycles is 1 to about 3. It is not recommended from the standpoints of dispersibility and photographic properties to elevate the temperature of the water dispersion under high pressure. High temperatures above 90° C. tend to increase the particle size and the fog due to poor dispersion. Accordingly, in the preferred embodiment of the invention, a cooling step is provided prior to the conversion step and/or after the pressure drop step whereby the water dispersion is maintained at a temperature in the range of 5 to 90° C., more preferably 5 to 80° C. and most preferably 5 to 65° C. It is effective to use the cooling step particularly when dispersion is effected under a high pressure of 1,500 to 3,000 kg/cm$^2$. The cooling means used in the cooling step may be selected from various coolers, for example, double tube type heat exchangers, static mixer-built-in double tube type heat exchangers, multi-tube type heat exchangers, and serpentine heat exchangers, depending on the necessary quantity of heat exchange. For increasing the efficiency of heat exchange, the diameter, gage and material of the tube are selected as appropriate in consideration of the pressure applied thereto. Depending on the necessary quantity of heat exchange, the refrigerant used in the heat exchanger may be selected from well water at 20° C., cold water at 5 to 10° C. cooled by refrigerators, and if necessary, ethylene glycol/water at −30° C.

In the dispersing operation according to the invention, the organic silver salt is preferably dispersed in the presence of dispersants or dispersing agents soluble in an aqueous medium. The dispersing agents used herein include synthetic anionic polymers such as polyacrylic acid, acrylic acid copolymers, maleic acid copolymers, maleic acid monoester copolymers, and acryloylmethyl-propanesulfonic acid copolymers; semi-synthetic anionic polymers such as carboxymethyl starch and carboxymethyl cellulose; anionic polymers such as alginic acid and pectic acid; compounds as described in Japanese Patent Application No. 350753/1995; well-known anionic, nonionic and cationic surfactants; well-known polymers such as polyvinyl alcohol, polyvinyl pyrrolidone, carboxymethyl cellulose, hydroxypropyl cellulose and hydroxypropylmethyl cellulose; and naturally occurring polymers such as gelatin. Of these, polyvinyl alcohol and water-soluble cellulose derivatives are especially preferred.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g/m$^2$, more preferably about 1 to 3 g/m$^2$, as expressed by a silver coverage per square meter of the element.

Photosensitive Silver Halide

Photosensitive silver halide is used in one preferred embodiment of the invention wherein the element is a photothermographic one.

The halogen composition of photosensitive silver halide is not critical and may be any of silver chloride, silver chlorobromide, silver bromide, silver iodobromide, and silver iodochlorobromide. The halogen composition in grains may have a uniform distribution or a non-uniform distribution wherein the halogen concentration changes in a stepped. or continuous manner. Silver halide grains of the core/shell structure are also useful. Such core/shell grains preferably have a multilayer structure of 2 to 5 layers, more preferably 2 to 4 layers. Silver chloride or silver chlorobromide grains having silver bromide localized at the surface thereof are also preferably used.

A method for forming the photosensitive silver halide according to the invention is well known in the art. Any of the methods disclosed in *Research Disclosure No.* 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is up to 0.20 μm, preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The photosensitive silver halide grains used herein may contain any of metals or metal complexes belonging to Groups VII and VIII (or Groups 7 to 10) in the Periodic Table. Preferred metals or central metals of metal complexes belonging to Groups VII and VIII in the Periodic Table are rhodium, rhenium, ruthenium, osmium, and iridium. The metal complexes may be used alone or in admixture of complexes of a common metal or different metals. The content of metal or metal complex is preferably $1\times10^{-9}$ mol to $1\times10^{-2}$ mol, more preferably $1\times10^{-8}$ mol to $1\times10^{-4}$ mol, per mol of silver. Illustrative metal complexes are those of the structures described in JP-A 225449/1995.

The rhodium compounds which can be used herein are water-soluble rhodium compounds, for example, rhodium (III) halides and rhodium complex salts having halogen, amine or oxalato ligands, such as hexachlororhodium(III) complex salt, pentachloroaquorhodium(III) complex salt, tetrachlorodiaquorhodium(III) complex salt, hexabromorhodium(III) complex salt, hexamminerhodium(III) complex salt, and trioxalatorhodium(III) complex salt. On use, these rhodium compounds are dissolved in water or suitable solvents. They are preferably added by a method commonly employed for stabilizing a solution of a rhodium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble rhodium, it is possible to add, during preparation of silver halide, separate silver halide grains previously doped with rhodium, thereby dissolving rhodium.

An appropriate amount of the rhodium compound added is $1\times10^{-8}$ to $5\times10^{-6}$ mol, especially $5\times10^{-8}$ to $1\times10^{-6}$ mol, per mol of silver halide.

The rhodium compounds may be added at an appropriate stage during preparation of silver halide emulsion grains or prior to the coating of the emulsion. Preferably, the rhodium compound is added during formation of the emulsion so that the compound is incorporated into silver halide grains.

In the practice of the invention, rhenium, ruthenium and osmium are added in the form of water-soluble complex salts as described in JP-A 2042/1988, 285941/1989, 20852/1990 and 20855/1990. Especially preferred are hexacoordinate complexes represented by the formula:

$$[ML_6]^{n-}$$

wherein M is Ru, Re or Os, L is a ligand, and letter n is equal to 0, 1, 2, 3 or 4. The counter ion is not critical although it is usually an ammonium or alkali metal ion. Preferred ligands are halide ligands, cyanide ligands, cyanate ligands, nitrosil ligands, and thionitrosil ligands.

Illustrative, non-limiting, examples of the complex used herein are given below.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RUCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)\ (CN)_5]^{2-}$ |
| $[Os(NS)Br_5]^{2-}$ | $[Os(O)_2(CN)_4]^{4-}$ | |

An appropriate amount of these compounds added is $1\times10^{-9}$ to $1\times10^{-5}$ mol, especially $1\times10^{-8}$ to $1\times10^{-6}$ mol, per mol of silver halide.

These compounds may be added at an appropriate stage during preparation of silver halide emulsion grains or prior to the coating of the emulsion. Preferably, the compound is added during formation of the emulsion so that the compound is incorporated into silver halide grains.

In order that the compound be added during formation of silver halide grains so that the compound is incorporated into silver halide grains, there can be employed a method of adding a powder metal complex or an aqueous solution of a powder metal complex dissolved together with NaCl or KCl, to a water-soluble salt or water-soluble halide solution during formation of grains; a method of preparing silver halide grains by adding an aqueous solution of a metal complex as a third solution when silver salt and halide solutions are simultaneously mixed, thereby simultaneously mixing the three solutions; or a method of admitting a necessary amount of an aqueous solution of a metal complex into a reactor during formation of grains. Of these, the method of adding a powder metal complex or an aqueous solution of a powder metal complex dissolved together with NaCl or KCl to a water-soluble halide solution is especially preferred.

For addition to surfaces of grains, a necessary amount of an aqueous solution of a metal complex can be admitted into a reactor immediately after formation of grains, during or after physical ripening or during chemical ripening.

As the iridium compound, a variety of compounds may be used. Examples include hexachloroiridium, hexammineiridium, trioxalatoiridium, hexacyanoiridium, and pentachloronitrosiliridium. These iridium compounds are used by dissolving in water or suitable solvents. They are preferably added by a method commonly employed for stabilizing a solution of an iridium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble iridium, it is possible to add, during preparation of silver halide, separate silver halide grains previously doped with iridium, thereby dissolving iridium.

The silver halide grains used herein may contain metal atoms such as cobalt, iron, nickel, chromium, palladium, platinum, gold, thallium, copper, and lead. Preferred compounds of cobalt, iron, chromium and ruthenium are hexacyano metal complexes. Illustrative, non-limiting, examples include ferricyanate, ferrocyanate, hexacyano-cobaltate, hexacyanochromate and hexacyanoruthenate ions. The distribution of the metal complex in silver halide grains is not critical. That is, the metal complex may be contained in silver halide grains uniformly or at a high concentration in either the core or the shell.

An appropriate amount of the metal added is $1\times10^{-9}$ to $1\times10^{-4}$ mol per mol of silver halide. The metal may be contained in silver halide grains by adding a metal salt in the form of a single salt, double salt or complex salt during preparation of grains.

Photosensitive silver halide grains may be desalted by any of well-known water washing methods such as noodle and flocculation methods although silver halide grains may be either desalted or not according to the invention.

The silver halide emulsion used herein should preferably be chemically sensitized. The chemical sensitization methods which can be used herein are sulfur, selenium, tellurium, and noble metal sensitization methods which are well known in the art. These methods may be used singly or in combination. When they are used together, preferred combinations are a combination of sulfur sensitization with gold sensitization, a combination of sulfur sensitization with selenium sensitization and gold sensitization, a combination of sulfur sensitization with tellurium sensitization and gold sensitization, and a combination of sulfur sensitization with selenium sensitization, tellurium sensitization and gold sensitization.

Sulfur sensitization is generally carried out by adding a sulfur sensitizer to an emulsion and agitating the emulsion at an elevated temperature above 40° C. for a certain time. The sulfur sensitizers used herein are well-known sulfur compounds, for example, sulfur compounds contained in gelatin as well as various sulfur compounds such as thiosulfates, thioureas, thiazoles, and rhodanines. Preferred sulfur compounds are thiosulfate salts and thiourea compounds. The amount of the sulfur sensitizer added varies with chemical ripening conditions including pH, temperature and silver halide grain size although it is preferably $10^{-7}$ to $10^{-2}$ mol, more preferably $10^{-5}$ to $10^{-3}$ mol per mol of silver halide.

It is also useful to use selenium sensitizers which include well-known selenium compounds. Specifically, selenium sensitization is generally carried out by adding an unstable selenium compound and/or non-unstable selenium compound to an emulsion and agitating the emulsion at elevated temperature above 40° C. for a certain time. Preferred examples of the unstable selenium compound include those described in JP-B 15748/1969, JP-B 13489/1968, JP-A 25832/1992, JP-A 109240/1992 and JP-A 121798/1991. Especially preferred are the compounds represented by general formulae (VIII) and (IX) in JP-A 324855/1992.

The tellurium sensitizers are compounds capable of forming silver telluride, which is presumed to become sensitization nuclei, at the surface or in the interior of silver halide grains. The production rate of silver telluride in a silver halide emulsion can be determined by the test method described in JP-A 313284/1993. Exemplary tellurium sensitizers include diacyltellurides, bis(oxycarbonyl)tellurides, bis(carbamoyl)tellurides, bis(oxycarbonyl)ditellurides, bis (carbamoyl)ditellurides, compounds having a P=Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocycles, tellurocarbonyl compounds, inorganic tellurium compounds, and colloidal tellurium. Examples are described in U.S. Pat. Nos. 1,623,499, 3,320,069, 3,772,031, BP 235,211, 1,121,496, 1,295,462, 1,396,696, Canadian Patent No. 800,958, JP-A 204640/1992, Japanese Patent Application Nos. 53693/1991, 131598/1991, 129787/1992, J. Chem. Soc. Chem. Commun., 635 (1980), ibid., 1102 (1979), ibid., 645 (1979), J. Chem. Soc. Perkin. Trans., 1, 2191 (1980), S. Patai Ed., The Chemistry of Organic Selenium and Tellurium Compounds, Vol. 1 (1986), ibid., Vol. 2 (1987). Especially preferred are the compounds represented by general formulae (II) , (III) and (IV) in JP-A 313284/1993.

The amounts of the selenium and tellurium sensitizers used vary with the type of silver halide grains, chemical ripening conditions and other factors although they are preferably about $10^{-8}$ to $10^{-2}$ mol, more preferably about $10^{-7}$ to $10^{-3}$ mol per mol of silver halide. The chemical sensitizing conditions are not particularly limited although preferred conditions include a pH of 5 to 8, a pAg of 6 to 11, more preferably 7 to 10, and a temperature of 40 to 95° C., more preferably 45 to 85° C.

Useful as the noble metal sensitizers are compounds of gold, platinum, palladium, and iridium, with gold sensitization being especially preferred. Examples of the gold sensitizer include chloroauric acid, potassium chloroaurate, potassium aurithiocyanate, and gold sulfide. An appropriate amount of the gold sensitizer is about $10^{-7}$ to $10^{-2}$ mol per mol of silver halide.

In the preparation of the silver halide emulsion used herein, any of cadmium salts, sulfite salts, lead salts, and thallium salts may be co-present in the silver halide grain forming step or physical ripening step.

Reduction sensitization may also be used in the practice of the invention. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

To the silver halide emulsion according to the invention, thiosulfonic acid compounds may be added by the method described in EP-A 293,917.

The silver halide emulsion in the recording element according to the invention may be a single emulsion or a mixture of two or more emulsions which are different in mean grain size, halogen composition, crystal habit or chemical sensitizing conditions.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

Reducing Agent

The thermographic recording element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For thermographic recording elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis-(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)-methane; combinations of bis-βp-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For thermographic recording elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl) aryldicarboxyimides such as (N,N-dimethylaminomethyl) phthalimide and N,N-(dimethylaminomethyl)-naphthalene-2,3-dicarboxyimide; blocked pyrazoles, isothiuronium derivatives and certain photo-bleach agents such as N,N'-hexamethylenebis(l-carbamoyl-3,5-dimethyl-pyrazole), 1,8-(3,6-diazaoctane)bis(isothiuroniumtrifluoro-acetate) and 2-tribromomethylsulfonyl-benzothiazole; 3-ethyl-5-{(3-ethyl-2-benzothiazolinylidene)-1-methyl-ethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine, 6-isobutylphthalazine, 6-tert-butylphthalazine, 5,7-dimethylphthalazine, and 2,3-dihydrophthalazine; combinations of phthalazine or derivatives thereof with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

At least one layer of the thermographic recording layers or image forming layers used herein is preferably an image forming layer wherein a polymer latex constitutes at least 50% by weight of the entire binder. This image forming layer is sometimes referred to as "inventive image forming layer" and the polymer latex used as the main binder therefor is referred to as "inventive polymer latex," hereinafter. Beside the image forming layer, the polymer latex may also be used in a protective layer or back layer. Particularly when the thermographic recording element of the invention is used in a printing application where dimensional changes are a problem, it is necessary to use the polymer latex in the protective layer and back layer too. It is understood that the "polymer latex" is as defined above in conjunction with the antistatic layer.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

In the image forming layer according to the invention, the polymer latex preferably constitutes at least 50% by weight, more preferably at least 70% by weight of the entire binder.

In the image forming layer according to the invention, a hydrophilic polymer may be added to the binder in an amount of up to 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably up to 30%, more preferably up to 15% by weight of the entire binder in the image-forming layer.

In the practice of the invention, the image forming layer is preferably formed by applying an aqueous coating solution followed by drying. The term "aqueous" has the same meaning as defined above in conjunction with the antistatic layer. The image forming layer preferably has an overall binder content of 0.2 to 30 g/m$^2$, more preferably 1 to 15 g/m$^2$. To the image forming layer according to the invention, a crosslinking agent for crosslinking, a surfactant for ease of application and other addenda may be added. Examples of these agents are the same as described above in conjunction with the antistatic layer.

Nucleatina Agent

In the thermographic recording element of the invention, a nucleating agent may be contained in the image forming layer or a layer disposed adjacent thereto for the purpose of forming high contrast images. The nucleating agents which can be used herein are preferably substituted alkene derivatives, substituted isoxazole derivatives, specific acetal compounds, and hydrazine derivatives.

The substituted alkene derivatives, substituted isoxazole derivatives, and specific acetal compounds used herein are preferably of the following formulas (1), (2), and (3), respectively.

(1)

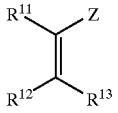

In formula (1), $R^{11}$, $R^{12}$, and $R^{13}$ are independently hydrogen or monovalent substituents, and Z is an electron attractive group or silyl group. $R^{11}$ and Z, $R^{12}$ and $R^{13}$, $R^{11}$ and $R^{12}$, or $R^{13}$ and Z, taken together, may form a cyclic structure.

(2)

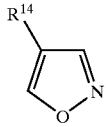

In formula (2), $R^{14}$ is a monovalent substituent.

(3)

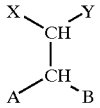

In formula (3), X and Y are independently hydrogen or monovalent substituents, A and B are independently alkoxy, alkylthio, alkylamino, aryloxy, arylthio, anilino, heterocyclic oxy, heterocyclic thio, or heterocyclic amino groups. X and Y, or A and B, taken together, may form a cyclic structure.

First, the substituted alkene derivatives of formula (1) are described in detail. In formula (1), $R^{11}$, $R^{12}$, and $R^{13}$ are independently hydrogen or substituents, and Z is an electron attractive group or silyl group. $R^{11}$ and Z, $R^{12}$ and $R^{13}$, $R^{11}$ and $R^{12}$, or $R^{13}$ and Z, taken together, may form a cyclic structure.

When $R^{11}$, $R^{12}$, and $R^{13}$ represent substituents, exemplary substituents include halogen atoms (e.g., fluorine, chlorine, bromine and iodine atoms), alkyl groups (including aralkyl, cycloalkyl and active methine groups), alkenyl groups, alkynyl groups, aryl groups, heterocyclic groups (inclusive of N-substituted nitrogenous heterocyclic groups), quaternized nitrogen atom-containing heterocyclic groups (such as pyridinio), acyl groups, alkoxycarbonyl groups, aryloxycarbonyl groups, carbamoyl groups, carboxy groups or salts thereof, imino groups, N-substituted imino groups, thiocarbonyl groups, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups or salts thereof, alkoxy groups (including groups containing recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, acylamino groups, sulfonamide groups, ureido groups, thioureido groups, imide groups, (alkoxy or aryloxy) carbonylamino groups, sulfamoylamino groups, semicarbazide groups, thiosemicarbazide groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, acylthio groups, (alkyl or aryl) sulfonyl groups, (alkyl or aryl) sulfinyl groups, sulfo groups or salts thereof, sulfamoyl groups, acylsulfamoyl groups, sulfonylsulfamoyl groups or salts thereof, phosphoryl groups, phosphoramide or phosphate structure-bearing groups, silyl groups, and stannyl groups. These substituents may be further replaced by other substituents selected from the foregoing examples.

In formula (1), Z is an electron attractive group or silyl group. The electron attractive group is a substituent whose Hammett substituent constant $\sigma p$ has a positive value. Exemplary electron attractive groups are cyano groups, alkoxycarbonyl groups, aryloxycarbonyl groups, carbamoyl groups, imino groups, N-substituted imino groups, thiocarbonyl groups, sulfamoyl groups, alkylsulfonyl groups, arylsulfonyl groups, nitro groups, halogen atoms, perfluoroalkyl groups, perfluoroalkaneamide groups, sulfonamide groups, acyl groups, formyl groups, phosphoryl groups, carboxy groups (or salts thereof), sulfo groups (or salts thereof), heterocyclic groups, alkenyl groups, alkynyl groups, acyloxy groups, acylthio groups, sulfonyloxy groups, and aryl groups having such electron attractive groups substituted thereon. The heterocyclic groups include saturated or unsaturated heterocyclic groups, for example, pyridyl, quinolyl, pyrazinyl, quinoxalinyl, benzotriazolyl, imidazolyl, benzimidazolyl, hydantoin-1-yl, succinimide and phthalimide groups.

The electron attractive group represented by Z in formula (1) may have a substituent or substituents which are selected from the same substituents that the substituents represented by $R^{11}$, $R^{12}$ and $R^{13}$ in formula (1) may have.

In formula (1), $R^{11}$ and Z, $R^{12}$ and $R^{13}$, $R^{11}$ and $R^{12}$ or $R^{13}$ and Z, taken together, may form a cyclic structure, which is a non-aromatic carbocyclic or non-aromatic heterocyclic one.

Described below is the preferred range of the compounds of formula (1). Preferred examples of the silyl group represented by Z in formula (1) include trimethylsilyl, t-butyldimethylsilyl, phenyldimethylsilyl, triethylsilyl, triisopropylsilyl, and trimethylsilyl-dimethylsilyl groups.

Preferred examples of the electron attractive group represented by Z in formula (1) include groups having 0 to 30 carbon atoms in total, for example, cyano, alkoxycarbonyl, aryloxycarbonyl, carbamoyl, thiocarbonyl, imino, N-substituted imino, sulfamoyl, alkylsulfonyl, arylsulfonyl, nitro, perfluoroalkyl, acyl, formyl, phosphoryl, acyloxy, and acylthio groups, and phenyl groups having an electron attractive group substituted thereon. More preferred examples include cyano, alkoxycarbonyl, carbamoyl, imino, sulfamoyl, alkylsulfonyl, arylsulfonyl, acyl, formyl, phosphoryl, and trifluoromethyl groups, and phenyl groups having an electron attractive group substituted thereon. Further preferred examples include cyano, formyl, acyl, alkoxycarbonyl, imino and carbamoyl groups.

The preferred groups represented by Z in formula (1) are electron attractive groups.

The substituents represented by $R^{11}$, $R^{12}$ and $R^{13}$ in formula (1) are preferably groups having 0 to 30 carbon atoms in total, for example, the same groups as the electron attractive groups represented by Z in formula (1), as well as alkyl, hydroxy (or salts thereof), mercapto (or salts thereof), alkoxy, aryloxy, heterocyclic oxy, alkylthio, arylthio, heterocyclic thio, amino, alkylamino, arylamino, heterocyclic amino, ureido, acylamino, sulfonamide, and substituted or unsubstituted aryl groups.

In formula (1), $R^{11}$ is preferably an electron attractive group, aryl group, alkylthio group, alkoxy group, acylamino group, hydrogen atom or silyl group.

When $R^{11}$ represents electron attractive groups, they are preferably groups of 0 to 30 carbon atoms, including cyano, nitro, acyl, formyl, alkoxycarbonyl, aryloxycarbonyl, thiocarbonyl, imino, N-substituted imino, alkylsulfonyl, arylsulfonyl, carbamoyl, sulfamoyl, trifluoromethyl, phosphoryl, carboxy (or salts thereof), and saturated or unsaturated heterocyclic groups; more preferably cyano, acyl, formyl, alkoxycarbonyl, carbamoyl, imino, N-substituted imino, sulfamoyl, carboxy (or salts thereof), and saturated or unsaturated heterocyclic groups; most preferably cyano, formyl, acyl, alkoxycarbonyl, carbamoyl, and saturated or unsaturated heterocyclic groups.

When $R^{11}$ represents aryl groups, they are preferably substituted or unsubstituted phenyl groups having 6 to 30 carbon atoms in total wherein the substituents, if any, are arbitrary although electron attractive substituents are preferred.

More preferably, $R^{11}$ in formula (1) is an electron attractive group or aryl group.

The substituents represented by $R^{12}$ and $R^{13}$ in formula (1) are preferably the same groups as the electron attractive groups represented by Z in formula (1), as well as alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino, and substituted or unsubstituted phenyl groups.

More preferably, one of $R^{12}$ and $R^{13}$ in formula (1) is hydrogen and the other is a substituent. In this case, preferred substituents are alkyl, hydroxy (or salts thereof), mercapto (or salts thereof), alkoxy, aryloxy, heterocyclic oxy, alkylthio, arylthio, heterocyclic thio, amino, alkylamino, anilino, heterocyclic amino, acylamino (especially perfluoroalkaneamide), sulfonamide, substituted or unsubstituted phenyl and heterocyclic groups; more preferably hydroxy (or salts thereof), mercapto (or salts thereof), alkoxy, aryloxy, heterocyclic oxy, alkylthio, arylthio, heterocyclic thio and heterocyclic groups; and most preferably hydroxy (or salts thereof), alkoxy or heterocyclic groups.

It is also preferred that Z and $R^{11}$, or $R^{12}$ and $R^{12}$ in formula (1) form a cyclic structure together. The cyclic structures formed are non-aromatic carbocyclic or non-aromatic heterocyclic structures, preferably 5- to 7-membered cyclic structures having 1 to 40 carbon atoms, more preferably 3 to 30 carbon atoms in total inclusive of the carbon atoms in substituents.

Especially preferred of the compounds of formula (1) are those wherein Z is a cyano, formyl, acyl, alkoxycarbonyl, imino or carbamoyl group, $R^{11}$ is an electron withdrawing group or aryl group, one of $R^{12}$ and $R^{13}$ is hydrogen and the other is a hydroxy (or salts thereof), mercapto (or salts thereof), alkoxy, aryloxy, heterocyclic oxy, alkylthio, arylthio, heterocyclic thio or heterocyclic group.

Also especially preferred of the compounds of formula (1) are those wherein Z and $R^{11}$ form a non-aromatic, 5- to 7-membered cyclic structure together, one of $R^{12}$ and $R^{13}$ is hydrogen and the other is a hydroxy (or salts thereof), mercapto (or salts thereof), alkoxy, aryloxy, heterocyclic oxy, alkylthio, arylthio, heterocyclic thio or heterocyclic group. In this case, Z which forms a non-aromatic cyclic structure with $R^{11}$ is preferably an acyl, carbamoyl, oxycarbonyl, thiocarbonyl or sulfonyl group while $R^{11}$ is preferably an acyl, carbamoyl, oxycarbonyl, thiocarbonyl, sulfonyl, imino, N-substituted imino, acylamino or carbonylthio group.

Secondly, the substituted isoxazole derivatives of formula (2) are described in detail. In formula (2), $R^{14}$ is a substituent. The definition and examples of the substituent represented by $R^{14}$ are the same as described for the substituents represented by $R^{11}$ to $R^{13}$ in formula (1).

In formula (2), the substituents represented by $R^{14}$ are preferably electron attractive groups or aryl groups. Preferred examples of the electron attractive groups include groups having 0 to 30 carbon atoms in total, such as cyano, nitro, acyl, formyl, alkoxycarbonyl, aryloxycarbonyl, alkylsulfonyl, arylsulfonyl, carbamoyl, sulfamoyl, trifluoromethyl, phosphoryl, imino, and saturated or unsaturated heterocyclic groups; more preferably cyano, acyl, formyl, alkoxycarbonyl, carbamoyl, sulfamoyl, alkylsulfonyl, arylsulfonyl, and heterocyclic groups; most preferably cyano, formyl, acyl, alkoxycarbonyl, carbamoyl, and heterocyclic groups.

When $R^{14}$ represents aryl, preferred aryl groups are substituted or unsubstituted phenyl groups having 6 to 30 carbon atoms in total. The substituents on the aryl groups are the same as described for the substituents represented by $R^{11}$ to $R^{13}$ in formula (1).

Preferably in formula (2), $R^{14}$ represents cyano, alkoxycarbonyl, carbamoyl, heterocyclic, or substituted or unsubstituted phenyl groups, and especially cyano, heterocyclic or alkoxycarbonyl groups.

Thirdly, the acetal compounds of formula (3) are described in detail. In formula (3), X and Y are independently hydrogen or substituents, A and B are independently alkoxy, alkylthio, alkylamino, aryloxy, arylthio, anilino, heterocyclic thio, heterocyclic oxy, or heterocyclic amino groups. X and Y, or A and B, taken together, may form a cyclic structure.

The substituents represented by X and Y are the same as described for the substituents represented by $R^{11}$ to $R^{13}$ in formula (1). Exemplary substituents are alkyl (inclusive of perfluoroalkyl and trichloromethyl), aryl, heterocyclic, halogen, cyano, nitro, alkenyl, alkynyl, acyl, formyl, alkoxycarbonyl, aryloxycarbonyl, imino, N-substituted imino, carbamoyl, thiocarbonyl, acyloxy, acylthio, acylamino, alkylsulfonyl, arylsulfonyl, sulfamoyl, phosphoryl, carboxy (or salts thereof), sulfo (or salts thereof), hydroxy (or salts thereof), mercapto (or salts thereof), alkoxy, aryloxy, heterocyclic oxy, alkylthio, arylthio, heterocyclic thio, amino, alkylamino, anilino, heterocyclic amino, and silyl groups. These groups may further have substituents. X and Y may bond together to form a cyclic structure, which may be either a non-aromatic carbocyclic or non-aromatic heterocyclic ring.

In formula (3), the groups represented by X and Y are preferably groups having 1 to 40 carbon atoms in total, more preferably 1 to 30 carbon atoms in total, and include cyano, alkoxycarbonyl, aryloxycarbonyl, carbamoyl, imino, N-substituted imino, thiocarbonyl, sulfamoyl, alkylsulfonyl, arylsulfonyl, nitro, perfluoroalkyl, acyl, formyl, phosphoryl, acylamino, acyloxy, acylthio, heterocyclic, alkylthio, alkoxy, and aryl groups.

In formula (3), more preferred substituents represented by X and Y are cyano, nitro, alkoxycarbonyl, carbamoyl, acyl, formyl, acylthio, acylamino, thiocarbonyl, sulfamoyl, alkylsulfonyl, arylsulfonyl, imino, N-substituted imino, phosphoryl, trifluoromethyl, heterocyclic, and substituted phenyl groups. Especially preferred are cyano, alkoxycarbonyl, carbamoyl, alkylsulfonyl, arylsulfonyl, acyl, acylthio, acylamino, thiocarbonyl, formyl, imino, N-substituted imino, heterocyclic groups and phenyl groups having an electron attractive group substituted thereon.

It is also preferred that X and Y bond together to form a non-aromatic carbocyclic or non-aromatic heterocyclic ring. In this case, the cyclic structures are preferably 5- to 7-membered rings and have 1 to 40 carbon atoms, especially 3 to 30 carbon atoms in total. X and Y forming a cyclic structure are preferably acyl, carbamoyl, oxycarbonyl, thiocarbonyl, sulfonyl, imino, N-substituted imino, acylamino, and carbonylthio groups.

In formula (3), A and B are independently alkoxy, alkylthio, alkylamino, aryloxy, arylthio, anilino, heterocyclic thio, heterocyclic oxy or heterocyclic amino groups. A and B, taken together, may form a ring. The groups represented by A and B in formula (3) are preferably groups having 1 to 40 carbon atoms in total, more preferably 1 to 30 carbon atoms in total, and may further have substituents.

It is more preferred in formula (3) that A and B bond together to form a cyclic structure. In this case, the cyclic structures are preferably 5- to 7-membered non-aromatic heterocycles and have 1 to 40 carbon atoms, especially 3 to 30 carbon atoms in total. Examples of A bonded to B (that is, —A—B—) include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S—, and —N(Ph)—$(CH_2)_2$—S—.

The compounds of formulas (1), (2), and (3) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The compounds of formulas (1), (2), and (3) may have incorporated therein a ballast group or polymer commonly used in immobile photographic additives such as couplers. The incorporation of a ballast group is one of the preferred embodiments of the present invention. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The compounds of formulas (1), (2), and (3) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). The incorporation of groups containing recurring ethylenoxy or propylenoxy units or (alkyl, aryl or heterocyclic) thio groups is one of the preferred embodiments of the present invention. Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Illustrative examples of the compounds of formulas (1), (2), and (3) are given below although the invention is not limited thereto.

C-1

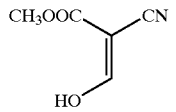

C-2

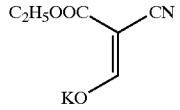

-continued
C-3
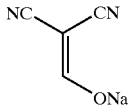
C-4
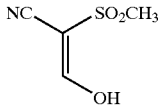
C-5
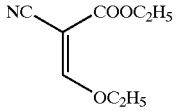
C-6
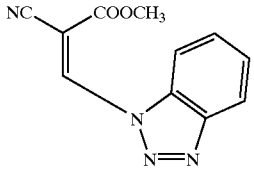
C-7
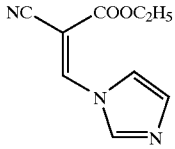
C-8
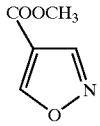
C-9
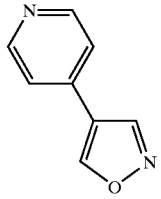
C-10
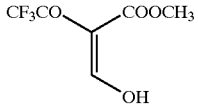
C-11
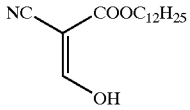
C-12
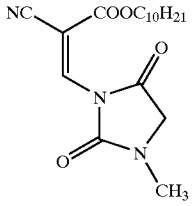
-continued
C-13
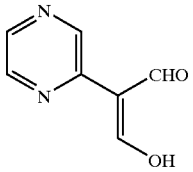
C-14
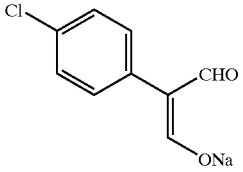
C-15
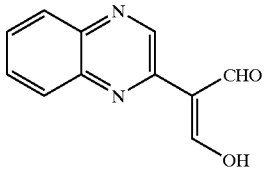
C-16
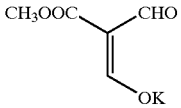
C-17
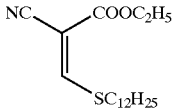
C-18
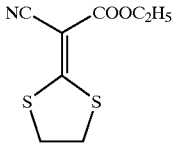
C-19
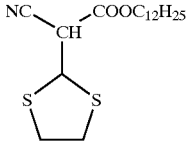
C-20
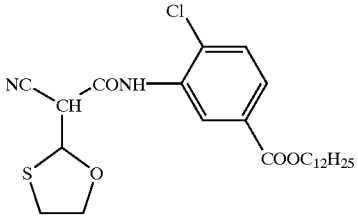
C-21
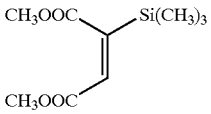
C-22
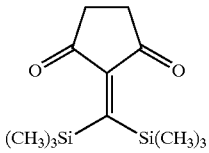

-continued
C-23
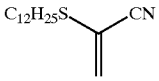
C-24
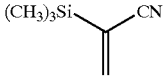
C-25
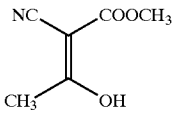
C-26
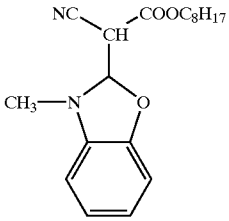
C-27
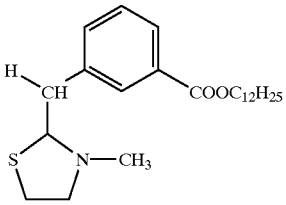
C-28
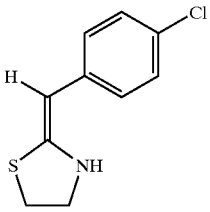
C-29
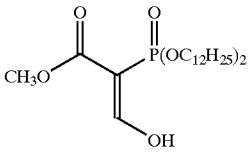
C-30
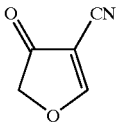
C-31
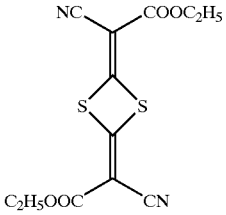
-continued
C-32
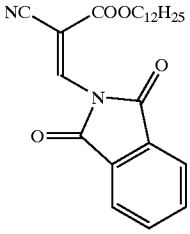
C-33
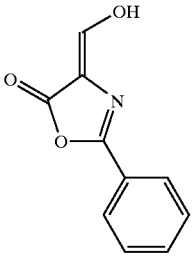
C-34
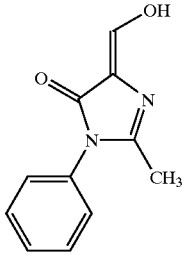
C-35
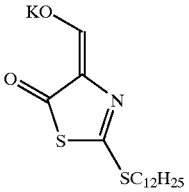
C-36
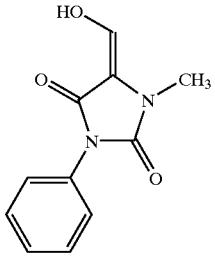
C-37
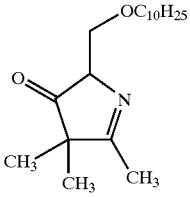

C-38
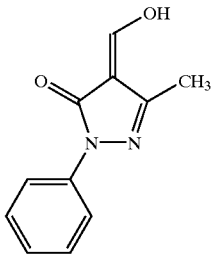
C-39
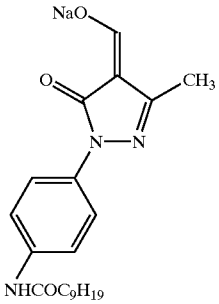
C-40
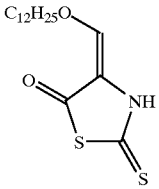
C-41
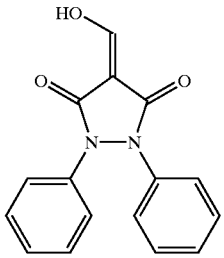
C-42
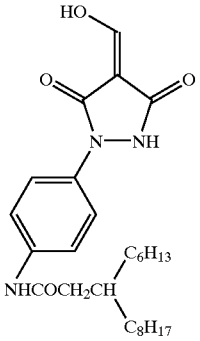
C-43
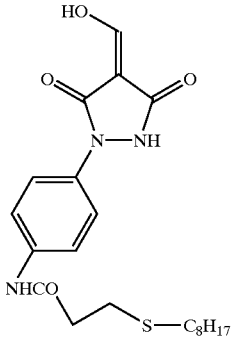
C-44
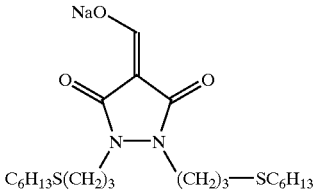
C-45
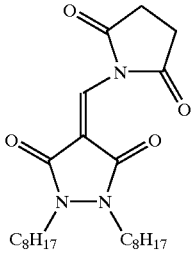
C-46
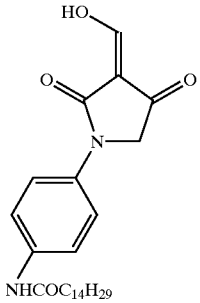
C-47
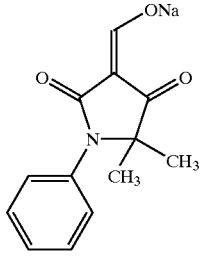

-continued
C-48
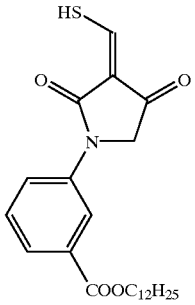
C-49
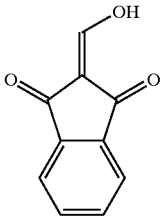
C-50
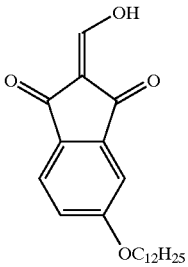
C-51
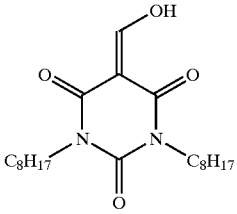
C-52
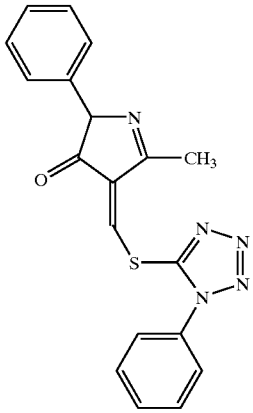
C-53
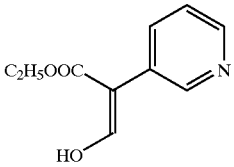
-continued
C-54
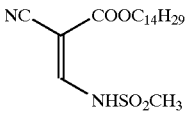
C-55
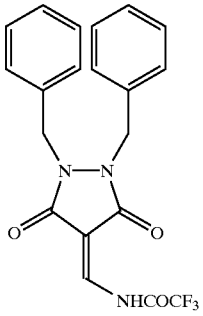
C-56
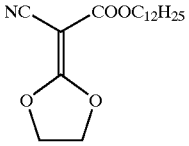
C-57
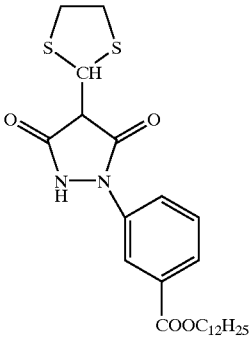
C-58
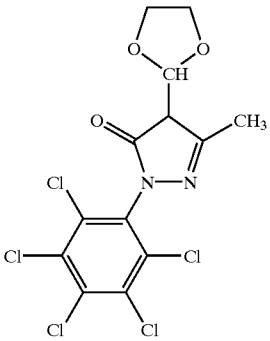

-continued

C-59

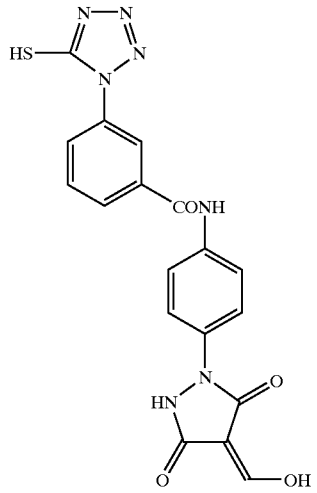

C-60

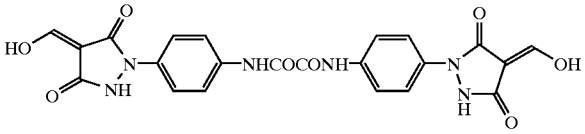

The compounds of formulas (1), (2), and (3) can be readily synthesized by well-known methods, for example, the methods described in U.S. Pat. Nos. 5,545,515, 5,635,339, and 5,654,130, WO 97/34196, and Japanese Patent Application Nos. 354107/1997, 309813/1997, and 272002/1997.

In the practice of the invention, the compound of formula (1) to (3) is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the compound of formula (1) to (3) with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the compound of formula (3) to (5) in powder form in a suitable solvent, typically water, in a ball mill, colloidal mill or ultrasonic mixer.

The compound of formula (1) to (3) may be added to a layer on the thermographic recording or image forming layer-bearing side of the support, that is, an image forming layer or any other layer on that side of the support, and preferably to the image forming layer or a layer disposed adjacent thereto.

The compound of formula (1) to (3) is preferably used in an amount of $1\times10^{-6}$ mol to 1 mol, more preferably $1\times10^{-5}$ mol to $5\times10^{-1}$ mol, and most preferably $2\times10^{-5}$ mol to $2\times10^{-1}$ mol per mol of silver.

The compounds of formulas (1) to (3) may be used alone or in admixture of two or more. In combination with the compounds of formulas (1) to (3), there may be used any of the compounds described in U.S. Pat. Nos. 5,545,515, 5,635,339, 5,654,130, and 5,686,228, WO 97/34196, and Japanese Patent Application Nos. 279962/1996, 228881/1997, 273935/1997, 354107/1997, 309813/1997, 296174/1997, 282564/1997, 272002/1997, 272003/1997, and 332388/1997.

Furthermore, the following hydrazine derivatives may be used in a suitable combination in the practice of the invention. The preferred hydrazine derivatives used herein are of the following formula (H).

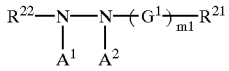

(H)

In formula (H), $R^{22}$ is an aliphatic, aromatic or heterocyclic group. $R^{21}$ is hydrogen or a block group. $G^1$ is —CO—, —COCO—, —C(=S)—, —$SO_2$—, —SO—, —PO($R^{23}$)— or imino-methylene group. $R^{23}$ is selected from the same groups as defined for $R^{21}$ and may be different from $R^{21}$. Both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter m1 is equal to 0 or 1. $R^{21}$ is an aliphatic, aromatic or heterocyclic group when m1 is 0.

In formula (H), the aliphatic groups represented by $R^{22}$ are preferably substituted or unsubstituted, normal, branched or cyclic alkyl, alkenyl and alkynyl groups having 1 to 30 carbon atoms.

In formula (H), the aromatic groups represented by $R^{22}$ are preferably monocyclic or fused ring aryl groups, for example, phenyl and naphthyl groups derived from benzene and naphthalene rings. The heterocyclic groups represented by $R^{22}$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl and alkyl groups are most preferred as $R^{22}$.

The groups represented by $R^{22}$ may have substituents. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoramide or phosphate structure. These substituents may be further substituted with such substituents.

Preferred substituents that $R^{22}$ may have include, where $R^{22}$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive. of salts thereof), (alkyl, aryl or heterocyclic) thio, sulfo (inclusive of salts thereof), sulfamoyl, halogen, cyano, and nitro groups.

Where $R^{22}$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R^{21}$ is hydrogen or a block group. Illustrative block groups are aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^{21}$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxy-propyl, 3-methanesulfonamidopropyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyano-phenyl, 2-hydroxymethylphenyl, 2,6-dichloro-4-cyanophenyl, and 2-chloro-5-octylsulfamoylphenyl groups.

The heterocyclic groups represented by $R^{21}$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, and quinolyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^{21}$ may be substituted ones, with examples of the substituent being as exemplified for the substituent on $R^{22}$.

In formula (H), $R^{21}$ may be such a group as to induce cyclization reaction to cleave a $G^1$—$R^{21}$ moiety from the remaining molecule to generate a cyclic structure containing the atoms of the —$G^1$—$R^{21}$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^{21}$ and $R^{22}$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^{21}$ or $R^{22}$ in formula (H) may have a plurality of hydrazino groups as substituents. In this case, the compounds of formula (H) are polymeric with respect to hydrazino groups. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^{21}$ or $R^{22}$ in formula (H) may contain a cationic group (e.g., a group containing a quaternary ammonio group or a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

In formula (H), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammett substituent constants may be −0.5 or more), or a substituted or unsubstituted acyl group having up to 20 carbon atoms (preferably a benzoyl group, a benzoyl group substituted such that the sum of Hammett substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

Illustrative, non-limiting, examples of the compound represented by formula (H) are given below.

TABLE 1
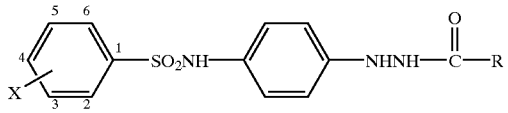
| | X = | R = —H or (—$C_2F_4$—$COO^{\ominus}K^{\oplus}$) | —$C_2F_4$—COOH | 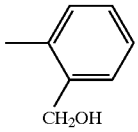 | 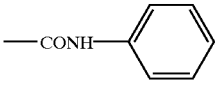 |
|---|---|---|---|---|---|
| 1 | 3-NHCO—$C_9H_{19}$(n) | 1a | 1b | 1c | 1d |
| 2 | 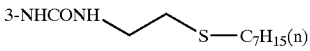 | 2a | 2b | 2c | 2d |
| 3 | 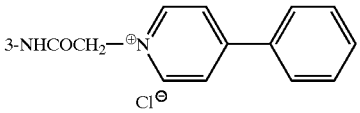 | 3a | 3b | 3c | 3d |
| 4 | 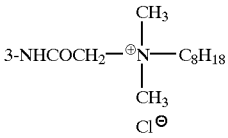 | 4a | 4b | 4c | 4d |
| 5 | 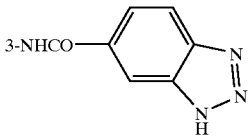 | 5a | 5b | 5c | 5d |
| 6 | 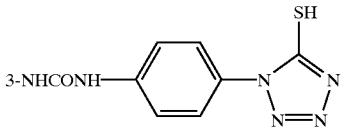 | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |
TABLE 2
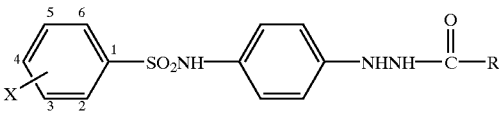
| | X = | R = —H | —$CF_2H$ | 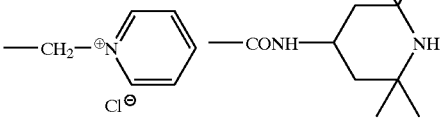 | |
|---|---|---|---|---|---|
| 8 | 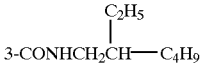 | 8a | 8e | 8f | 8g |

TABLE 2-continued
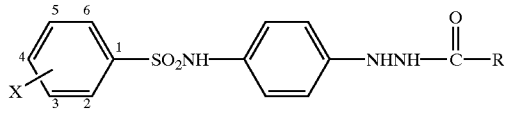
| | X = | R = —H | —$CF_2H$ | 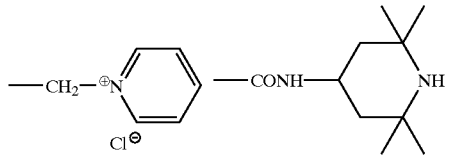 | |
|---|---|---|---|---|---|
| 9 | 6-$OCH_3$-3-$C_5H_{11}$(t) | 9a | 9e | 9f | 9g |
| 10 | 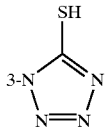 | 10a | 10e | 10f | 10g |
| 11 | 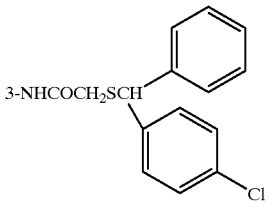 | 11a | 11e | 11f | 11g |
| 12 | 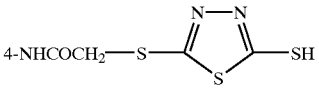 | 12a | 12e | 12f | 12g |
| 13 | 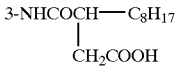 | 13a | 13e | 13f | 13g |
| 14 | 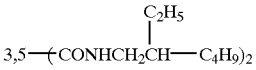 | 14a | 14e | 14f | 14g |
TABLE 3
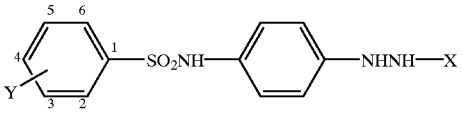
| | Y = | X = —CHO | —$COCF_3$ | —$SO_2CH_3$ | —$P(OC_2H_5)_2$ |
|---|---|---|---|---|---|
| 15 | 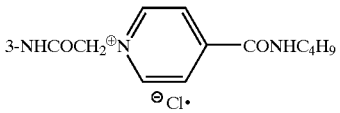 | 15a | 15h | 15i | 15j |

TABLE 3-continued
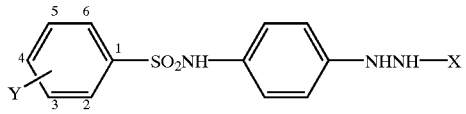
| | Y = | X = —CHO | —$COCF_3$ | —$SO_2CH_3$ | —$P(OC_2H_5)_2$ (O) |
|---|---|---|---|---|---|
| 16 | 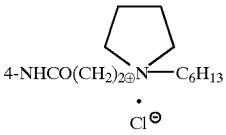 | 16a | 16h | 16i | 16j |
| 17 | 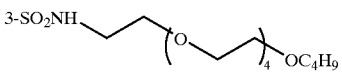 | 17a | 17h | 17i | 17j |
| 18 | 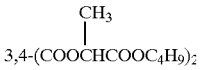 | 18a | 18h | 18i | 18j |
| 19 | 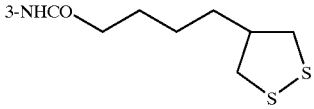 | 19a | 19h | 19i | 19j |
| 20 | 3-$NHSO_2NH$—$C_8H_{17}$ | 20a | 20h | 20i | 20j |
| 21 | 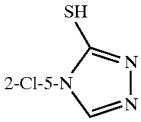 | 21a | 21h | 21i | 21j |
TABLE 4
22
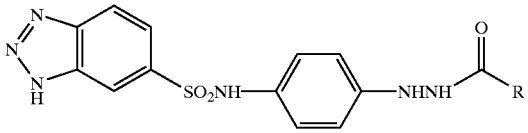
23
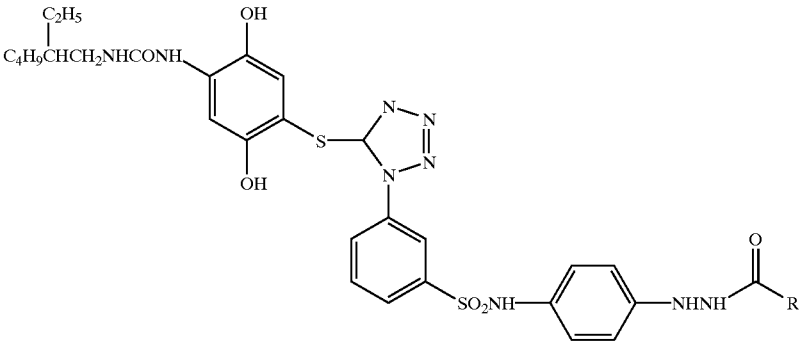

TABLE 4-continued
24
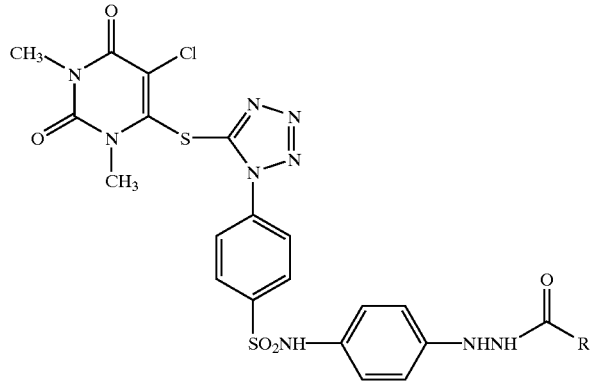
25
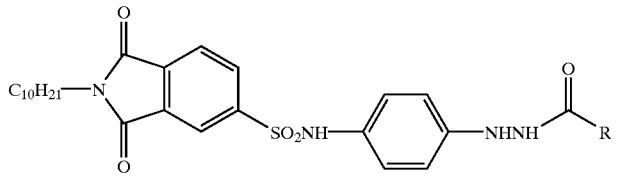
26
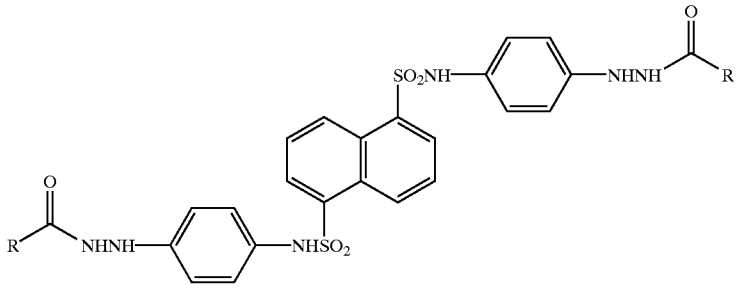
27
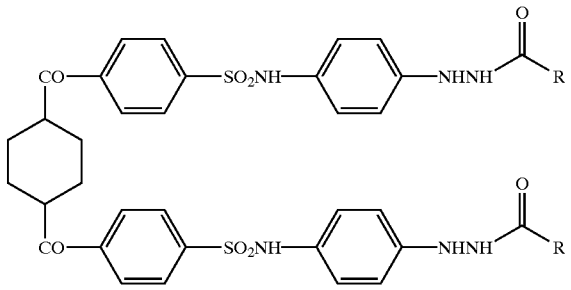
28
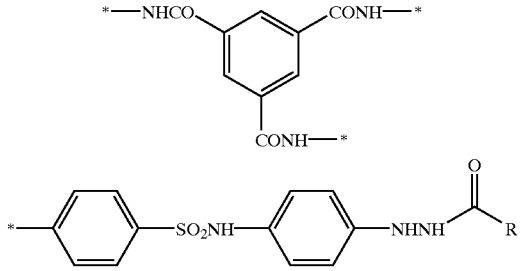

TABLE 4-continued
| | R = | | | |
|---|---|---|---|---|
| | —H | —$CF_3$ | 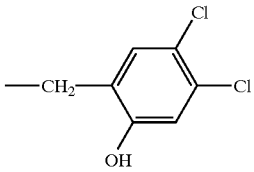 | —CONH |
| 22 | 22a | 22h | 22k | 22l |
| 23 | 23a | 23h | 23k | 23l |
| 24 | 24a | 24h | 24k | 24l |
| 25 | 25a | 25h | 25k | 25l |
| 26 | 26a | 26h | 26k | 26l |
| 27 | 27a | 27h | 27k | 27l |
| 28 | 28a | 28h | 28k | 28l |
TABLE 5
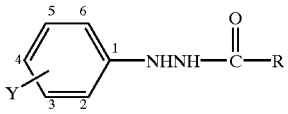
| | | R = | | | |
|---|---|---|---|---|---|
| | Y = | —H | —$CH_2OCH_3$ | 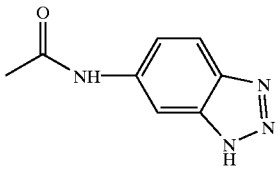 | 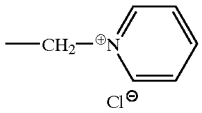 |
| 29 | 4-NHCNH—$C_8H_{17}$(n) (S) | 29a | 29m | 29n | 29f |
| 30 | 4-NHP(O)(OCH$_2$—)$_2$ | 30a | 30m | 30n | 30f |
| 31 | 4-NHCONH—$(CH_2)_3O$— | 31a | 31m | 31n | 31f |
| 32 | 4-OH<br>3-NHCONHCH$_2$CH($C_2H_5$)—$C_4H_9$ | 32a | 32m | 32n | 32f |
| 33 | 4-NHSO$_2$(CH$_2$)$_2$NHCO— | 33a | 33m | 33n | 33f |
| 34 | 4-OCH$_2$— | 34a | 34m | 34n | 34f |

TABLE 5-continued
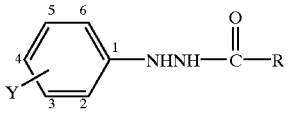
| | Y = | R = —H | —$CH_2OCH_3$ | 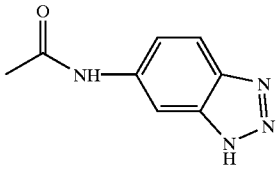 | 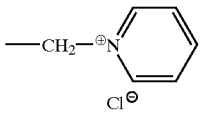 |
|---|---|---|---|---|---|
| 35 | 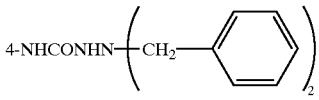 | 35a | 35m | 35n | 35f |
TABLE 6
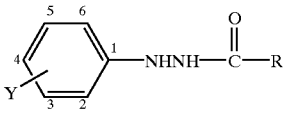
| | Y = | R = —H | —$CF_2SCH_3$ | —$CONHCH_3$ | 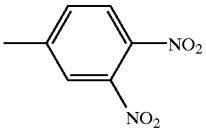 |
|---|---|---|---|---|---|
| 36 | 2-$NHSO_2CH_3$— 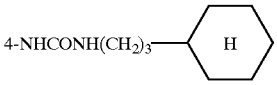 | 36a | 36o | 36p | 36q |
| 37 | 2-$OCH_3$— 4-$NHSO_2C_{12}H_{25}$ | 37a | 37o | 37p | 37q |
| 38 | 3-$NHCOC_{11}H_{23}$— 4-$NHSO_2CF_3$ | 38a | 38o | 38p | 38q |
| 39 | 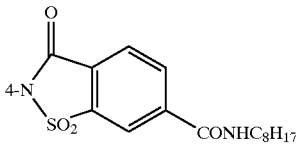 | 39a | 39o | 39p | 39q |
| 40 | 4-$OCO(CH_2)_2COOC_6H_{13}$ | 40a | 40o | 40p | 40q |
| 41 | 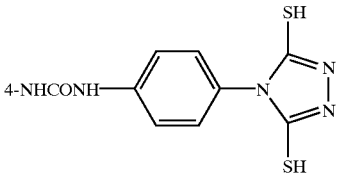 | 41a | 41o | 41p | 41q |

TABLE 6-continued
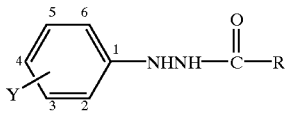
| Y = | R = —H | —$CF_2SCH_3$ | —$CONHCH_3$ | 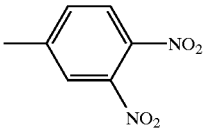 |
|---|---|---|---|---|
| 42 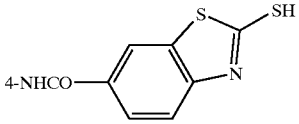 | 42a | 42o | 42p | 42q |
TABLE 7
43
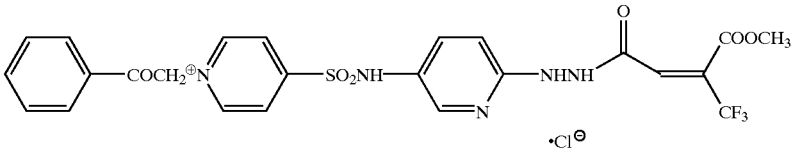
44
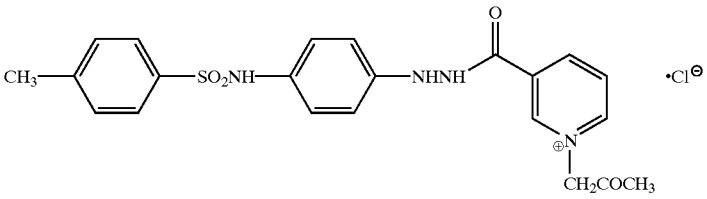
45
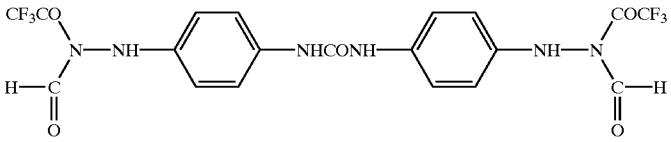
46
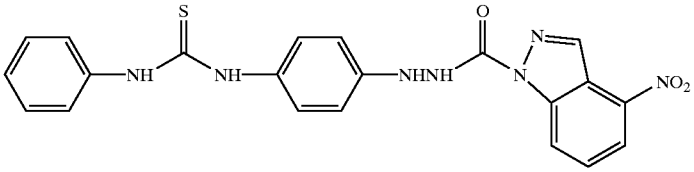
47
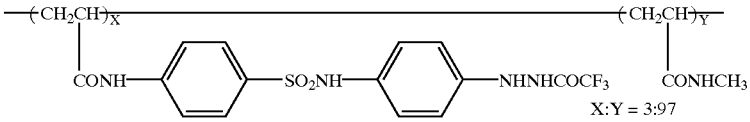
X:Y = 3:97
average molecular weight~100,000

TABLE 7-continued
48
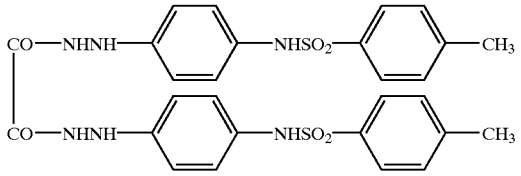
49
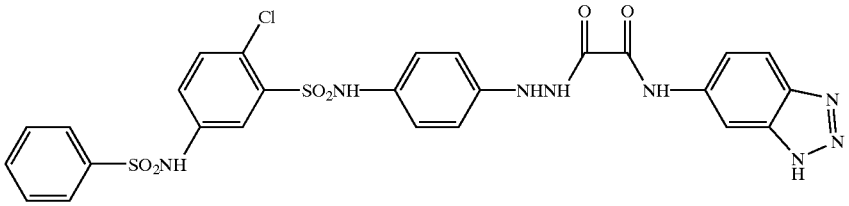
50
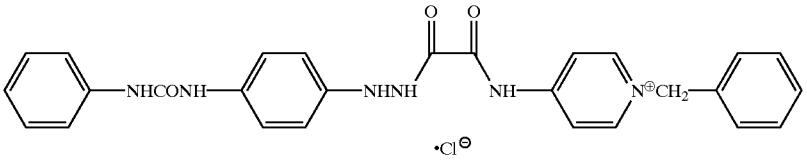
TABLE 8
51
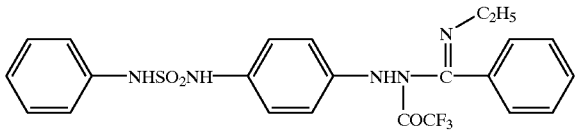
52
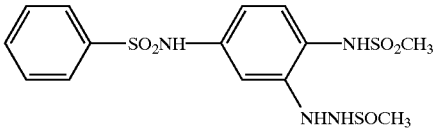
53
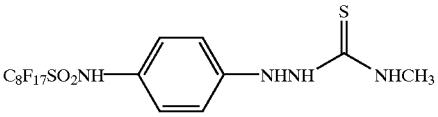
TABLE 9
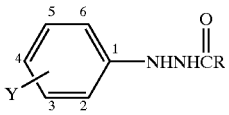
| | R = | | | |
|---|---|---|---|---|
| Y = | —H | —$CH_2OCH_3$ | —$CH_2O$— 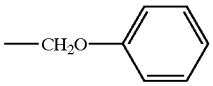 | —$CONHC_3H_7$ |
| 54 2-$OCH_3$ | 54a | 54m | 54r | 54s |
| 55 2-$OCH_3$ 5-$C_8H_{17}$(t) | 55a | 55m | 55r | 55s |
| 56 4-$NO_2$ | 56a | 56m | 56r | 56s |
| 57 4-$CH_3$ | 57a | 57m | 57r | 57s |

TABLE 9-continued
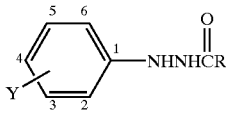
| Y = | R = —H | —$CH_2OCH_3$ | —$CH_2O$— 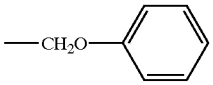 | —$CONHC_3H_7$ |
|---|---|---|---|---|
| 58 4-NHCO— 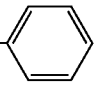 | 58a | 58m | 58r | 58s |
| 59 4-NHCN(O)($CH_2$— 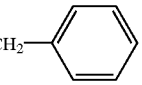 )($CH_2$— 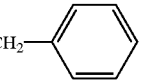 ) | 59a | 59m | 59r | 59s |
TABLE 10
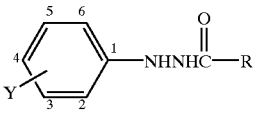
| Y = | R = —H | 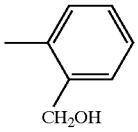 | —$CH_2$—$^{\oplus}N$  $\cdot Cl^{\ominus}$ | —CONH— 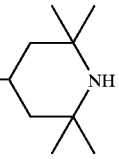 |
|---|---|---|---|---|
| 60 2-$OCH_3$ 5-$OCH_3$ | 60a | 60c | 60f | 60g |
| 61 4-$C_8H_{17}$(t) | 61a | 61c | 61f | 61g |
| 62 4-$OCH_3$ | 62a | 62c | 62f | 62g |
| 63 3-$NO_2$ | 63a | 63c | 63f | 63g |
| 64 4-NHCO— 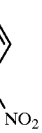 $NO_2$ | 64a | 64c | 64f | 64g |
| 65 4-NHC(O)NH— 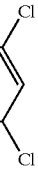 Cl, Cl | 65a | 65c | 65f | 65g |

TABLE 11
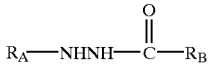
| | $R_A$ = | $R_B$ = —H | —$CH_2O$— 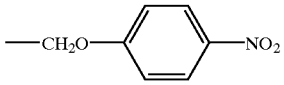 | 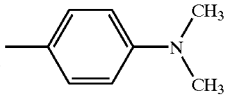 | —NH— 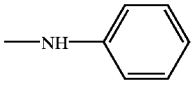 |
|---|---|---|---|---|---|
| 66 | 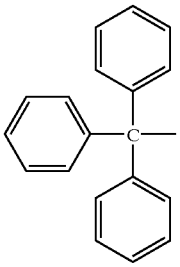 | 66a | 66u | 66v | 66t |
| 67 | 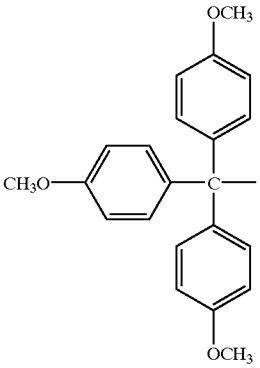 | 67a | 67u | 67v | 67t |
| 68 | 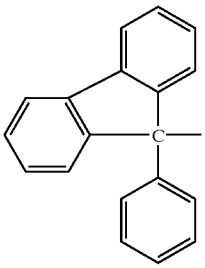 | 68a | 68u | 68v | 68t |
| 69 | 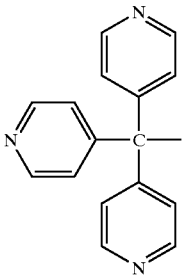 | 69a | 69u | 69v | 69t |

TABLE 11-continued
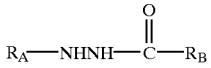
| | $R_B$ = | | | |
|---|---|---|---|---|
| $R_A$ = | —H | —$CH_2O$— 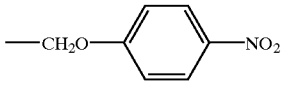 | — 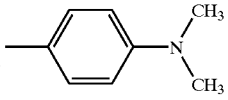 | —NH— 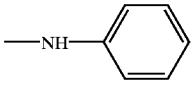 |
| 70 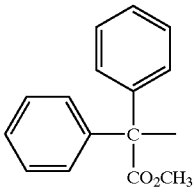 | 70a | 70u | 70v | 70t |
| 71 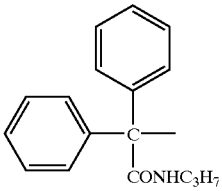 | 71a | 71u | 71v | 71t |
TABLE 12
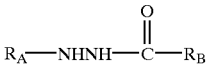
| | $R_B$ = | | | |
|---|---|---|---|---|
| $R_A$ = | —C(=O)$NHC_3H_7$ | —C(=O)O—$C_4H_9$(t) | —$OC_4H_9$(t) | — 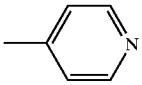 |
| 72 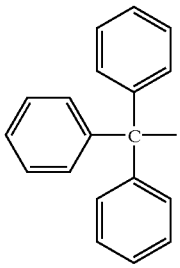 | 72s | 72x | 72y | 72w |

TABLE 12-continued
| | $R_A$ = | $R_A$—NHNH—C(=O)—$R_B$ $R_B$ = —C(=O)NHC$_3$H$_7$ | —C(=O)O—C$_4$H$_9$(t) | —OC$_4$H$_9$(t) | 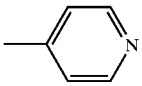 |
|---|---|---|---|---|---|
| 73 | 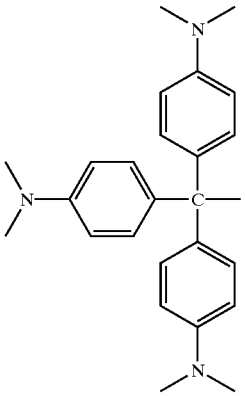 | 73s | 73x | 73y | 73w |
| 74 | 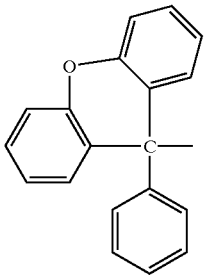 | 74s | 74x | 74y | 74w |
| 75 | 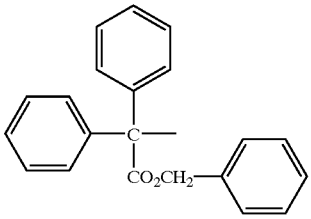 | 75s | 75x | 75y | 75w |
| 76 | 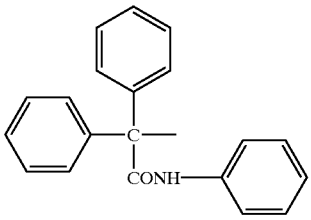 | 76s | 76x | 76y | 76w |

TABLE 13
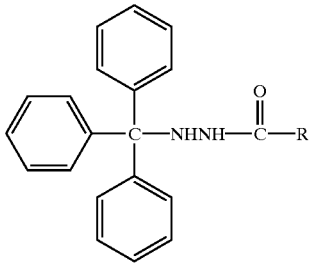
R =
77
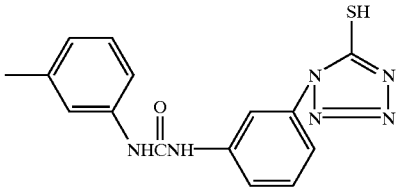
78
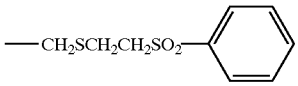
79 $—CH_2OCH_2CH_2SCH_2CH_2OCH_3$
80 $—CF_2CF_2COOH$
81
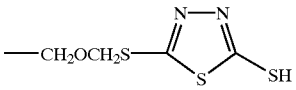
82
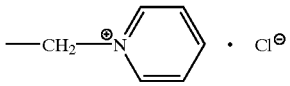
TABLE 14
83
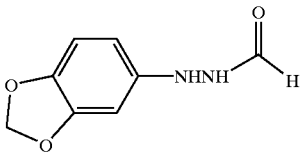
84
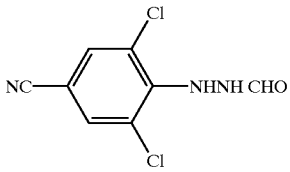
TABLE 14-continued
84
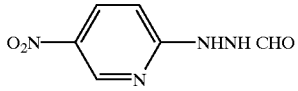
85
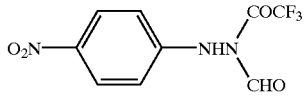
86
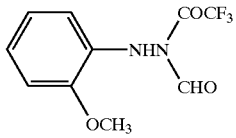
87
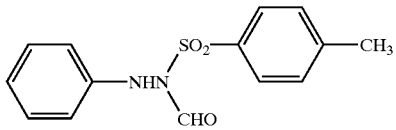
88
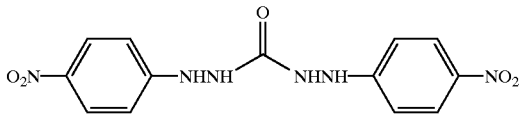

TABLE 15
| | |
|---|---|
| 89 | 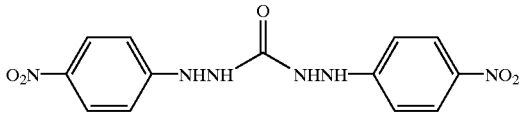 |
| 90 | 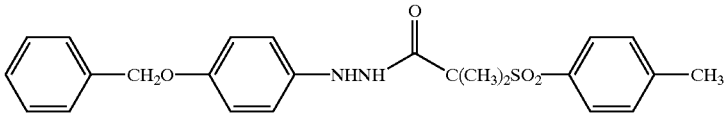 |
| 91 | 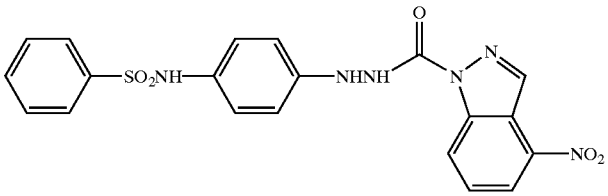 |
| 92 | 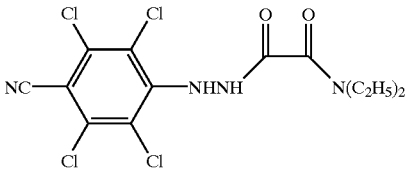 |
| 93 | 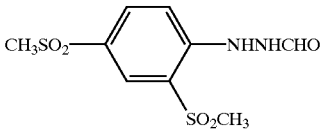 |
| 94 | 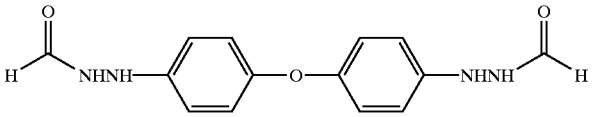 |
TABLE 16
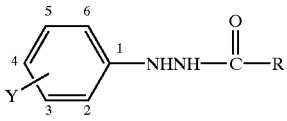
| | Y = | R = |
|---|---|---|
| 95 | 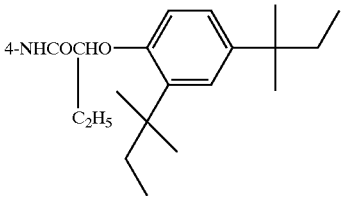 | 95-1 |
| 96 | 4-COOH | 96-1 |

TABLE 16-continued
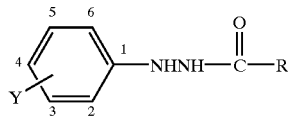
| | | |
|---|---|---|
| 97 | 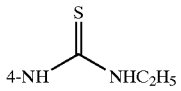 | 97-1 |
| 98 | 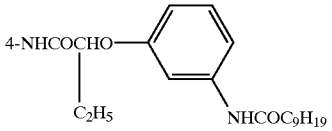 | 98-1 |
| 99 | 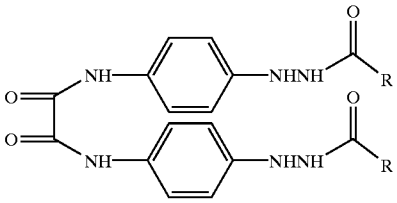 | 99-1 |
| 100 | 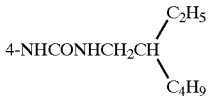 | 100-1 |
| | R = | | |
|---|---|---|---|
| | 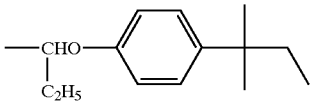 | 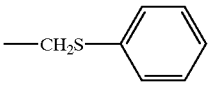 | —$CH_2$—Cl |
| 95 | 95-2 | 95-3 | 95-4 |
| 96 | 96-2 | 96-3 | 96-4 |
| 97 | 97-2 | 97-3 | 97-4 |
| 98 | 98-2 | 98-3 | 98-4 |
| 99 | 99-2 | 99-3 | 99-4 |
| 100 | 100-2 | 100-3 | 100-4 |
TABLE 17
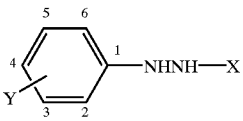
| | | X = | |
|---|---|---|---|
| | Y = | 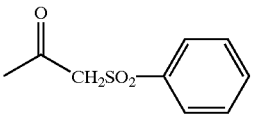 | 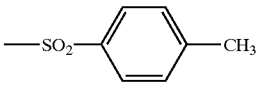 |
| 101 | 4-$NO_2$ | 101-5 | 101-6 |
| 102 | 2,4-$OCH_3$ | 102-5 | 102-6 |
| 103 | 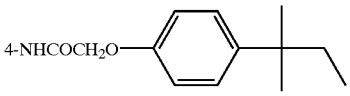 | 103-5 | 103-6 |

TABLE 17-continued
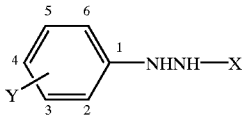
| | Y = | X = 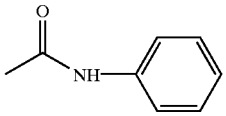 | X = 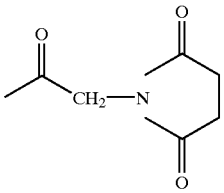 |
|---|---|---|---|
| 104 | 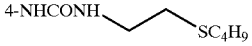 | 104-8 | 104-9 |
| 105 | 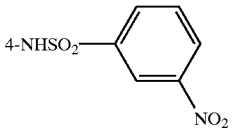 | 105-8 | 105-9 |
| | X = 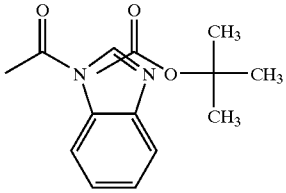 | | |
|---|---|---|---|
| | 101 | 101-7 | 101y |
| | 102 | 102-7 | 102y |
| | 103 | 103-7 | 103y |
| | X = 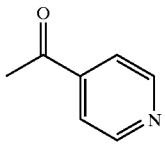 | X = 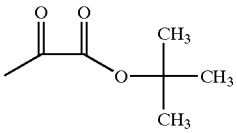 | |
|---|---|---|---|
| | 104 | 104w' | 104x |
| | 105 | 105w' | 105x |

TABLE 18
| | Y—NH NH—X | | | | |
|---|---|---|---|---|---|
| | | X = | | | |
| | Y = | 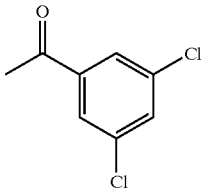 | 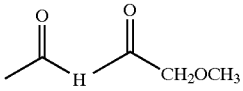 | 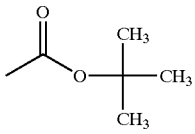 | |
| 106 | 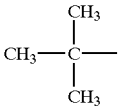 | 106-10 | 106a | 106m | 106y |
| 107 | 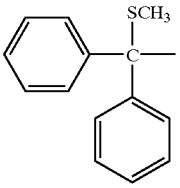 | 107-10 | 107a | 107m | 107y |
| 108 | 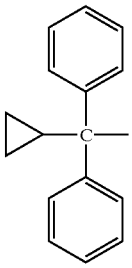 | 108-10 | 108a | 108m | 108y |
| 109 | 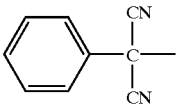 | 109-10 | 109a | 109m | 109y |
| 110 | 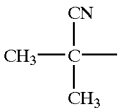 | 110-10 | 110a | 110m | 110y |
| 111 | 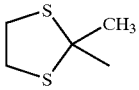 | 111-10 | 111a | 111m | 111y |

TABLE 19
| | | Y—NH NH—X | | | |
|---|---|---|---|---|---|
| | | X = | | | |
| | Y = | 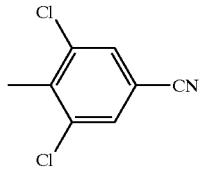 | 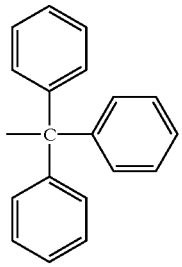 | 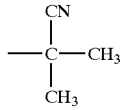 | 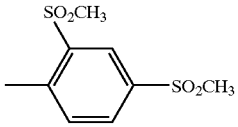 |
| 112 | 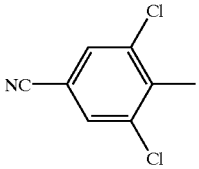 | 112-11 | 112-12 | 112-13 | 112-14 |
| 113 | 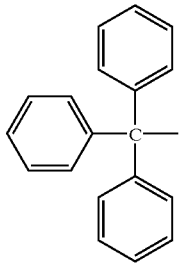 | 113-11 | 113-12 | 113-13 | 113-14 |
| 114 | 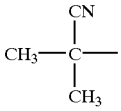 | 114-11 | 114-12 | 114-13 | 114-14 |
| 115 | 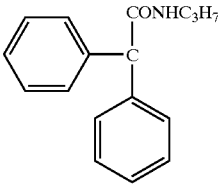 | 115-11 | 115-12 | 115-13 | 115-14 |
| 116 | 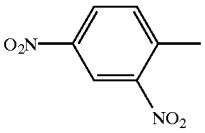 | 116-11 | 116-12 | 116-13 | 116-14 |
| 117 | 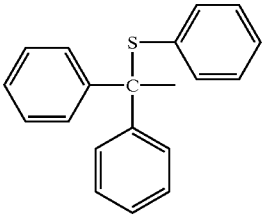 | 117-11 | 117-12 | 117-13 | 117-14 |

TABLE 20
118
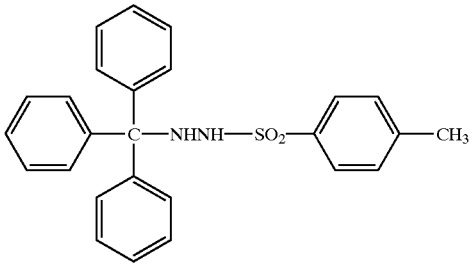
119
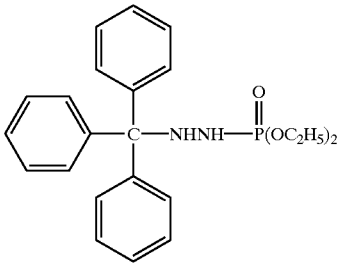
120
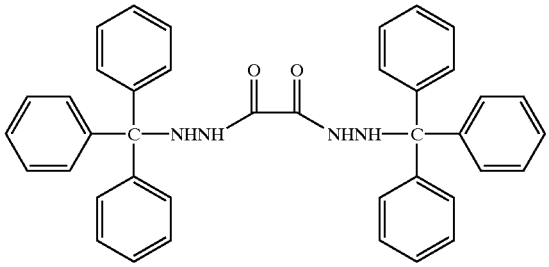
121
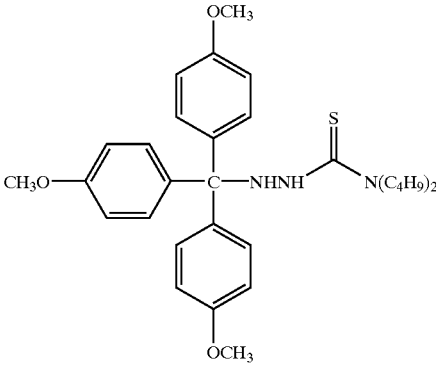
122
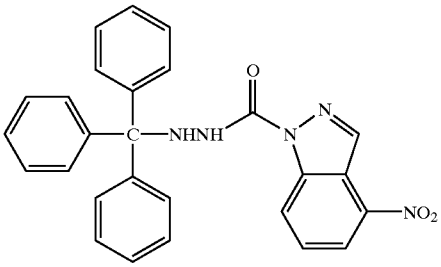

TABLE 20-continued
| | |
|---|---|
| 123 | 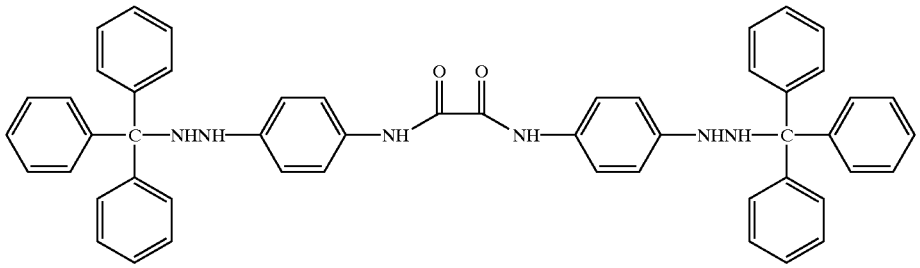 |
TABLE 21
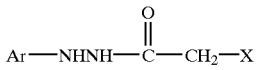
| | | X = | | | | | |
|---|---|---|---|---|---|---|---|
| | Ar = | —OH | —SH | —NHCOCF$_3$ | —NHSO$_2$CH$_3$ | —NHSO$_2$ph | —N(CH$_3$)$_2$ |
| 124 | 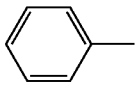 | 124a | 124b | 124c | 124d | 124e | 124f |
| 125 | 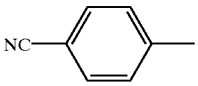 | 125a | 125b | 125c | 125d | 125e | 125f |
| 126 | 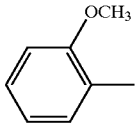 | 126a | 126b | 126c | 126d | 126e | 126f |
| 127 | 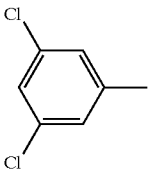 | 127a | 127b | 127c | 127d | 127e | 127f |
| 128 | 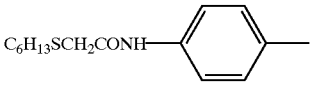 | 128a | 128b | 128c | 128d | 128e | 128f |
| 129 | 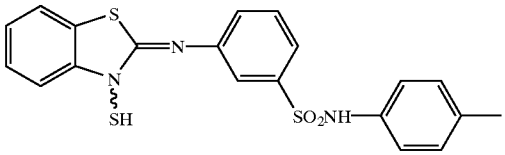 | 129a | 129b | 129c | 129d | 129e | 129f |
| 130 | 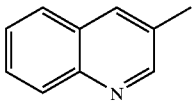 | 130a | 130b | 130c | 130d | 130e | 130f |
| 131 | 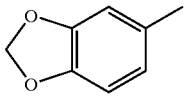 | 131a | 131b | 131c | 131d | 131e | 131f |

TABLE 21-continued

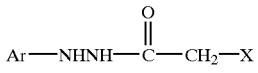

| Ar = | X = —OH | —SH | —NHCOCF$_3$ | —NHSO$_2$CH$_3$ | —NHSO$_2$ph | —N(CH$_3$)$_2$ |
|---|---|---|---|---|---|---|
| 132 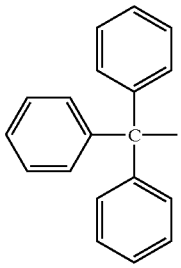 | 132a | 132b | 132c | 132d | 132e | 132f |
| 133 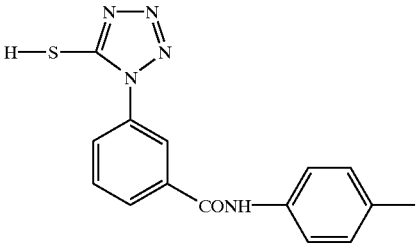 | 133a | 133b | 133c | 133d | 133e | 133f |
| 134 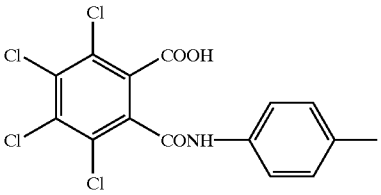 | 134a | 134b | 134c | 134d | 134e | 134f |

TABLE 22

| | |
|---|---|
| 135 | 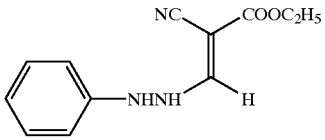 |
| 136 | 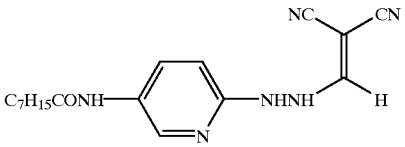 |
| 137 | 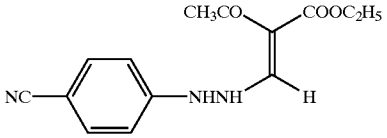 |

The hydrazine derivatives of formula (H) may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (H). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K. K., Mar. 22, 1991, pages 25–34 and Compounds D-2 and D-39 described in JP-A 86354/1987, pages 6–7.

In the practice of the invention, the hydrazine nucleating agent is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethyl sulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to a layer on the thermographic recording or image forming layer-bearing side of the support, that is, an image forming layer or any other binder layer on that side of the support, and preferably to the image forming layer or a binder layer disposed adjacent thereto.

The nucleating agent is preferably used in an amount of $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol per mol of silver.

Also in the practice of the invention, contrast promoting agents may be used in combination with the aforementioned nucleating agents or contrast enhancers for forming high contrast images. Such ultrahigh contrast promoting agents include the amine compounds described in U.S. Pat. No. 5,545,505, specifically Compounds AM-1 to AM-5 therein, the hydroxamic acids described in U.S. Pat. No. 5,545,507, specifically HA-1 to HA-11 therein, the acrylonitriles described in U.S. Pat. No. 5,545,507, specifically CN-1 to CN-13 therein, the hydrazine compounds described in U.S. Pat. No. 5,558,983, specifically CA-1 to CA-6 therein, the onium salts described in Japanese Patent Application No. 132836/1996, specifically A-1 to A-42, B-1 to B-27 and C-1 to C-14.

The synthesis methods, addition methods, and addition amounts of these nucleating agents and contrast promoting agents are as described in the above-listed patents.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in *Research Disclosure,* Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red laser diodes, and LED.

For compliance with laser diode light sources in the wavelength range of 750 to 1,400 nm, it is advantageous to spectrally sensitize silver halide grains. Such spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidine-dione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. No. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent, examples of which are the cyanine dyes described in JP-A 58239/1987, 132638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. No. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in *Research Disclosure,* Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to-the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pats. No. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $10^{-9}$ mol to $10^{-3}$ mol, more preferably $10^{-8}$ mol to $10^{-4}$ mol per mol of silver coated.

Still further, the thermographic recording element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the recording element, preferably to a layer on the same side as the photosensitive layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $10^{-6}$ to 2 mol, more preferably $10^{-3}$ to 0.5 mol per mol of silver.

In the element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M' and Ar—S—S—Ar wherein M' is a hydrogen atom or alkali metal atom, and Ar is an aromatic ring or fused aromatic ring having at least one nitrogen, sulfur, oxygen, selenium or tellurium atom. Preferred heteroaromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms), and aryl groups (optionally substituted). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, and 2-mercapto-4-phenyloxazole.

These mercapto compounds are preferably added to the image forming layer (or photosensitive layer) in amounts of 0.0001 to 1.0 mol, more preferably 0.001 to 0.3 mol per mol of silver.

In the image forming layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Protective Layer

A surface protective layer may be provided in the thermographic recording element of the present invention for the purpose of preventing sticking of the image forming layer.

The surface protective layer is based on a binder which may be any desired polymer, although the layer preferably contains 100 mg/m$^2$ to 5 g/m$^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 grams of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the photosensitive layer or image forming layer according to the invention, various dyes and pigments may be used for the purpose of improving the tone or preventing irradiation. Illustratively, the dyes described in conjunction with the antistatic layer are preferred although the invention is not limited thereto. The amount of such dyes or pigments used is determined in accordance with the desired absorbance although it is usually in the range of 1 $\mu$g to 1 g per square meter.

In the one-side recording element according to the invention, a matte agent may be added to the surface protective layer on the image forming layer for the purpose of improving transportation. The matte agents used herein are as described above in conjunction with the antistatic layer.

The photothermographic emulsion used in the thermographic element according to the preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic element, a combination of such two layers may be employed for each color. Also a single layer may contain all necessary components as described in U.S. Pat. No. 4,708,928. In the case of multi-dye, multi-color sensitive photothermographic element, emulsion (or photosensitive) layers are distinctly supported by providing a functional or non-functional barrier layer therebetween as described in U.S. Pat. No. 4,460,681.

A backside resistive heating layer as described in U.S. Pat. Nos. 4,460,681 and 4,374,921 may be used in a photographic thermographic image recording system according to the present invention.

According to the invention, a hardener may be used in various layers including an image forming layer, protective layer, and back layer as partially described above. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties as partially described above. The surfactants used herein may be the same as described in conjunction with the antistatic layer.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated $\alpha$-olefin polymers, especially polymers of $\alpha$-olefins having 2 to 10 carbon atoms such as polyethylene, polypropylene, and ethylene-butene copolymers. The supports are either transparent or opaque, preferably transparent. Of these, biaxially oriented polyethylene terephthalate (PET) films of about 75 to 200 μm thick are preferred.

When plastic film is passed through a thermographic processor where it will encounter a temperature of at least 80° C., the film experiences dimensional shrinkage or expansion. When the thermographic element as processed is intended for printing plate purposes, this dimensional shrinkage or expansion gives rise to a serious problem against precision multi-color printing. Therefore, the invention favors the use of a film experiencing a minimal dimensional change, that is, a film which has been biaxially stretched and then properly treated for mitigating the internal distortion left after stretching and for preventing distortion from being generated by thermal shrinkage during subsequent heat development. One exemplary material is polyethylene terephthalate (PET) film which has been heat treated at 100 to 210° C. prior to the coating of a photographic thermographic emulsion. Also useful are materials having a high glass transition temperature (Tg), for example, polyether ethyl ketone, polystyrene, polysulfone, polyether sulfone, polyarylate, and polycarbonate.

A method for producing color images using the photothermographic element of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic layer or image forming layer can be formed by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the thermographic recording element of the invention, there may be contained additional layers, for example, a dye accepting layer for accepting a mobile dye image, an opacifying layer when reflection printing is desired, a protective topcoat layer, and a primer layer well known in the photothermographic art. The recording element of the invention is preferably such that only a single sheet of the recording element can form an image. That is, it is preferred that a functional layer necessary to form an image such as an image receiving layer does not constitute a separate member.

The thermographic recording element of the invention may be developed by any desired method although it is generally developed by heating after imagewise exposure. The developing apparatus used herein include heat developing apparatus of the contact type in which the thermographic recording element is brought into contact with a heat source such as a heat roller or heat drum as described in JP-B 56499/1993, Japanese Patent No. 684453, JP-A 292695/1997, JP-A 297385/1997 and WO 95/30934; and heat developing apparatus of the non-contact type as described in JP-A 13294/1995, WO 97/28489, 97/28488, and 97/28487. The heat developing apparatus of the non-contact type are especially preferred. The preferred developing temperature is about 80 to 250° C., more preferably 100 to 140° C. The preferred developing time is about 1 to 180 seconds, more preferably about 10 to 90 seconds.

One effective means for preventing the thermographic recording element from experiencing process variations due to dimensional changes during heat development is a method (known as a multi-stage heating method) of heating the element at a temperature of 80° C. to less than 115° C. (preferably up to 113° C.) for at least 5 seconds so that no images are developed and thereafter, heating at a temperature of at least 110° C. (preferably up to 130° C.) for heat development to form images.

Any desired technique may be used for the exposure of the thermographic recording element of the invention. The preferred light source for exposure is a laser, for example, a gas laser, YAG laser, dye laser or semiconductor laser. A semiconductor laser combined with a second harmonic generating device is also useful.

Owing to low haze upon exposure, the thermographic recording element of the invention tends to generate interference fringes. Known techniques for preventing generation of interference fringes are a technique of obliquely directing laser light to a photosensitive material as disclosed in JP-A 113548/1993 and the utilization of a multi-mode laser as disclosed in WO 95/31754. Exposure is preferably carried out in combination with these techniques.

Upon exposure of the thermographic recording element of the invention, exposure is preferably made by overlapping laser light so that no scanning lines are visible, as disclosed in SPIE, Vol. 169, Laser Printing 116–128 (1979), JP-A 51043/1992, and WO 95/31754.

EXAMPLE

Examples of the invention are given below by way of illustration and not by way of limitation.

Example 1

Samples A-101 to A-132 were prepared as follows.

(1) Preparation of Supports

Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 120 μm after heat curing.

The film was longitudinally stretched by a factor of 3.3 by means of rollers rotating at different circumferential speeds and then transversely stretched by a factor of 4.5 by means of a tenter. The temperatures in these stretching steps were 110° C. and 130° C., respectively. Thereafter, the film was heat cured at 240° C. for 20 seconds and then transversely relaxed 4% at the same temperature. Thereafter, with the chuck of the tenter being slit and the opposite edges being knurled, the film was taken up under a tension of 4.8 kg/cm$^2$. In this way, a film of 2.4 m wide, 3,500 m long and 120 μm thick was obtained in a roll form.

(2) Preparation of Back-coated Samples (BC-A 101 to 132)

A coating solution A was prepared by mixing the following ingredients.

Jurimer ET410 (30% water dispersion) 32.9 g (acrylic resin water dispersion,

Nippon Junyaku K.K.)

Gelatin 6.3 g

Compound A 0.02 g

Conductive metal oxide particles (Table 23)

Polyoxyethylene phenyl ether 1 g

Sumitex Resin M-3 (8% aqueous solution) 22 g (water-soluble melamine compound,

Sumitomo Chemical Industry K.K.)

Dye A 2.1 g

Matte agent (Table 23)

Water to make 1000 g

The conductive metal oxide particles used are SN-100F and FS-10D both commercially available from Ishihara Industry K.K. SN-100F is a dispersion in water of Sb-doped $SnO_2$ (spherical particles, mean particle size 0.1 μm). FS-10D is a dispersion in water of Sb-doped $SnO_2$ (acicular particles, length/breadth 20–30, length 0.2–2.0 μm, breadth 0.01–0.02 μm). The matte agent used is polymethyl methacrylate (PMMA) having a mean particle size 5 μm. Dye A used is a compound of the following formula while the chemical formula of Compound A is shown later.

Dye A

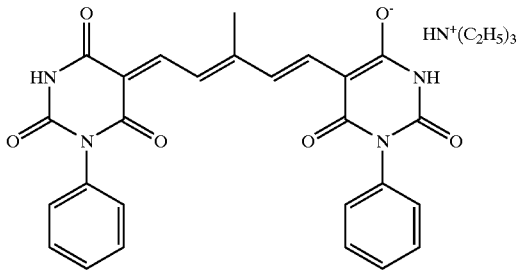

The coating solution A was applied onto one surface (back surface) of the support and dried at 180° C. for 30 seconds, forming a first layer having a dry thickness as reported in Table 23.

A coating solution B was prepared by mixing the following ingredients.

Chemipearl S-120 (27% water dispersion) 90 g (polyolefin water dispersion, Mitsui Petro-Chemical K.K.)

Snowtex C (30% water dispersion) 60 g (colloidal silica water dispersion, Nissan Chemical K.K.)

Polystyrene sulfonate (Mw 1000–5000) 3 g

Denacol EX614B (1% aqueous solution) 90 g (epoxy compound, Nagase Chemicals K.K.)

Distilled water 757 g

The coating solution B was applied onto the first layer and dried at 170° C. for 30 seconds, forming a second layer having a dry thickness as reported in Table 23. The back-coated samples BC-A 101 to 132 were completed in this way.

(3) Preparation of Undercoated Samples (Base-A 101 to 132) (Undercoat Layer on the Thermographic Recording Layer-bearing Side)

A coating solution C was prepared by mixing the following ingredients.

Styrene/butadiene copolymer latex 152 g (styrene:butadiene=67:30, solids 40 wt %)

Polystyrene microparticulates (mean particle size 2 μm) 0.1 g

Distilled water 847.9 g

The coating solution C was applied to the other surface of the back-coated sample (BC-A) and dried at 180° C. for 30 seconds, forming a first undercoat layer of 0.3 μm thick.

A coating solution D was prepared by mixing the following ingredients.

Gelatin 15 g

Acetic acid (20% aqueous solution) 10 g

Compound A 0.04 g

Dye A 1.3 g

Methyl cellulose (2% aqueous solution) 23.3 g

Distilled water 950 g

The coating solution D was applied onto the first undercoat layer and dried at 170° C. for 30 seconds, forming a second undercoat layer of 0.15 μm thick. The undercoated samples (Base-A 101 to 132) were completed in this way.

The thus prepared samples having back coated and undercoated sides (Base-A 101 to 132) each were passed through a heat treating zone having an overall length of 200 m and set at 200° C. at a feed speed of 20 m/min under a tension of 3 kg/m$^2$. Thereafter, the sample was passed through a zone set at 40° C. for 15 seconds and taken up into a roll under a tension of 10 kg/cm$^2$.

(4) Preparation of Thermographic Recording Layer (Emulsion Layer)

Silver halide emulsion A

In 700 ml of water were dissolved 11 g of phthalated gelatin, 30 mg of potassium bromide, and 10 mg of sodium benzenethiosulfonate. The solution was adjusted to pH 5.0 at a temperature of 55° C. To the solution, 159 ml of an aqueous solution containing 18.6 g of silver nitrate and an aqueous solution containing 1 mol/liter of potassium bromide were added over 6½ minutes by the controlled double jet method while maintaining the solution at pAg 7.7. Then, 476 ml of an aqueous solution containing 55.5 g of silver nitrate and an aqueous solution containing 1 mol/liter of potassium bromide were added over 28½ minutes by the controlled double jet method while maintaining the solution at pAg 7.7. Thereafter, the pH of the solution was lowered to cause flocculation and sedimentation for desalting. Further, 0.17 g of Compound A and 23.7 g of deionized gelatin (calcium content below 20 ppm) were added to the solution, which was adjusted to pH 5.9 and pAg 8.0. There were obtained cubic grains of silver halide having a mean grain size of 0.11 μm, a coefficient of variation of the projected area of 8%, and a (100) face proportion of 93%.

The thus obtained silver halide grains were heated at 60° C., to which 76 μmol of sodium benzenethiosulfate was added per mol of silver. After 3 minutes, 154 μmol of sodium thiosulfate was added and the emulsion was ripened for 100 minutes.

Thereafter, the emulsion was maintained at 40° C., and with stirring, $6.4\times10^{-4}$ mol of Sensitizing Dye A and $6.4\times10^{-3}$ mol of Compound B were added per mol of silver halide. After 20 minutes, the emulsion was quenched to 30° C., completing the preparation of a silver halide emulsion A.

Sensitizing Dye A

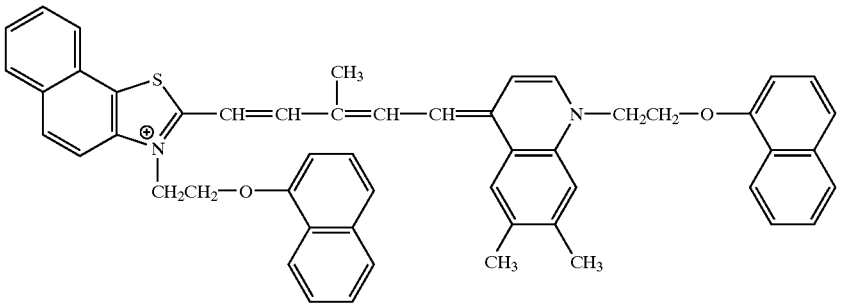

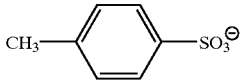

Compound A

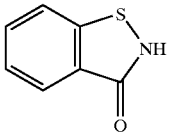

Compound B

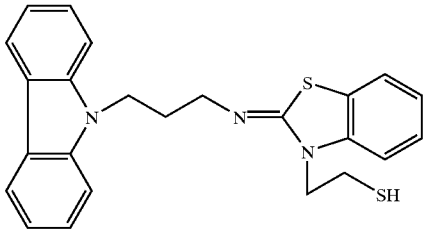

Organic acid silver dispersion

While a mixture of 4.4 g of arachic acid, 39.4 g of behenic acid, and 770 ml of distilled water was stirred at 85° C., 103 ml of 1N NaOH aqueous solution was added over 60 minutes. Reaction was carried out for 240 minutes. The solution was cooled to 75° C. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 $\mu$S/cm. The thus obtained solids were handled as a wet cake without drying. To 100 g as dry solids of the wet cake, 5 g of polyvinyl alcohol PVA-205 (Kurare K. K.) and water were added to a total weight of 500 g. This was pre-dispersed in a homomixer.

The pre-dispersed liquid was processed three times by a dispersing machine Micro-Fluidizer M-11OS-EH (with G10Z interaction chamber, manufactured by Microfluidex International Corporation) which was operated under a pressure of 1,750 kg/cm$^2$. There was obtained an organic acid silver dispersion. The organic acid silver grains in this dispersion were acicular grains having a mean minor axis (or breadth) of 0.04 $\mu$m, a mean major axis (or length) of 0.8 $\mu$m, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Solid particle dispersion of 1.1-bis(2-hydroxy-3.5-dimethylphenyl)-3.5.5-trimethylhexane To 20 g of 1,1-bis(2-hydroxy-3,5-dimethylphenyl)-3,5,5-trimethylhexane were added 3.0 g of polyvinyl alcohol MP-203 (Kurare K. K.) and 77 ml of water. They were thoroughly agitated to form a slurry, which was allowed to stand for 3 hours. A vessel was charged with the slurry together with 360 g of zirconia beads having a mean diameter of 0.5 mm. A dispersing machine 1/4G Sand Grinder Mill (Imex K. K.) was operated for 3 hours for dispersion, obtaining a solid particle dispersion of the reducing agent in which particles with a diameter of 0.3 to 1.0 $\mu$m accounted for 80% by weight.

Solid particle dispersion of tribromomethylphenylsulfone

To 30 g of tribromomethylphenylsulfone were added 0.5 g of hydroxypropylmethyl cellulose, 0.5 g of Compound C, and 88.5 g of water. They were thoroughly agitated to form a slurry, which was allowed to stand for 3 hours. Following the steps used in the preparation of the solid particle dispersion of the reducing agent, a solid particle dispersion of the antifoggant was prepared in which particles with a diameter of 0.3 to 1.0 $\mu$m accounted for 80% by weight.

Emulsion layer coating solution

To the above-prepared organic silver salt grain dispersion (corresponding to 1 mol of silver) were added the above-prepared silver halide emulsion A and the binder and addenda described below. Water was added thereto to form an emulsion layer coating solution.

LACSTAR 3307B binder (SBR latex, Tg 17° C.,

Dai-Nippon Ink & Chemicals K.K.) as solids 470 g 1,1-bis(2-hydroxy-3,5-dimethylphenyl)-3,5,5-trimethylhexane as solids 110 g Tribromomethylphenylsulfone as solids 25 g Sodium benzenethiosulfonate 0.25 g Polyvinyl alcohol MP-203 (Kurare K. K.) 46 g 6-Isobutylphthalazine 0.12 mol Nucleating agent A 0.9 g Nucleating agent B 0.9 g Dye A 0.62 g Silver halide emulsion A as Ag 0.05 mol Compound C, Nucleating agents A and B have the following chemical formulas.

Compound C

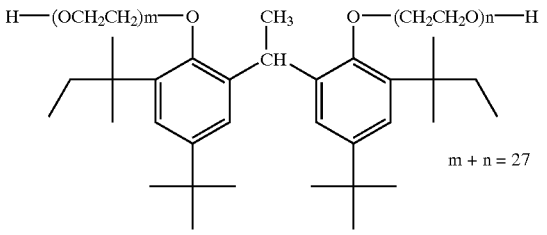

Nucleating agent A

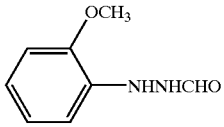

Nucleating agent B

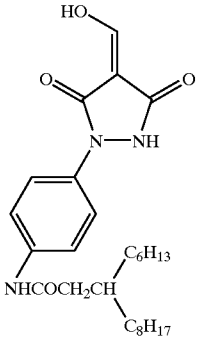

Emulsion surface protective layer coating solution

A surface protective layer coating solution was prepared by adding 3.75 g of $H_2O$ to 109 g of a polymer latex having a solids content of 27.5% (methyl methacrylate/styrene/2-ethylhexyl acrylate/2-hydroxyethyl methacrylate/methacrylic acid =59/9/26/5/1 copolymer, Tg 55° C.), then adding 4.5 g of benzyl alcohol as a film-forming aid, 0.45 g of Compound D, 0.125 g of Compound E, 0.0125 mol of Compound F, and 2.25 g of polyvinyl alcohol PVA-217 (Kurare K. K.), and diluting with water to a total weight of 150 g.

Compound D

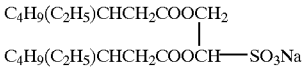

Compound E

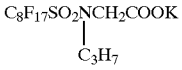

Compound F

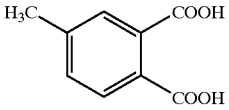

Thermographic recording element

The samples having back-coated and undercoated sides (Base-A 101 to 132) were used as the support. The emulsion layer coating solution was applied onto the undercoat layer of the support to a silver coverage of 1.6 g/m$^2$. The emulsion surface protective layer coating solution was applied thereon so that the coverage of the polymer latex (as solids) was 2.0 g/m$^2$, obtaining thermographic recording element samples, A-101 to 132.

Tests (1) Transparency

Without exposure, recording element samples were subjected to heat development at 115° C. for 15 seconds in a heat developing apparatus. Ten such samples were stacked and placed on a white paper sheet having characters of 10.5 points printed thereon whereupon the characters were visually observed from above through the stacked samples. Transparency was compared in terms of character readability and rated on a 5-point scale. Higher points indicate better transparency, with point 3 or lower being commercially unacceptable.

(2) Antistatic Effect

After the recording element was allowed to stand in an atmosphere at 25° C. and RH 10% for 24 hours for conditioning, it was cut to a length of 20 m in an atmosphere of RH 10%. Using a simple rewinder, the length of the recording element was wound and unwound 5 times at a line speed of 10 m/min. Without exposure, the recording element was subjected to heat development at 115° C. for 45 seconds. Black peppers caused by static electricity were found in those samples with insufficient antistatic effect. The level of black peppers generated was rated on a 5-point scale. Higher points indicate better antistatic effect, with point 3 or lower indicating that undesirable black peppers develop during the manufacturing and processing processes.

(3) Fragment Fall-off

The recording element was allowed to stand in an atmosphere at 25° C. and RH 50% for 24 hours for conditioning. A tester in the form of a metal cylinder with a radius of 2 cm having a black paper sheet secured to its end face was moved 50 strokes on the back layer of the element under a load of 100 g. The amount of particulates or fragments that separated from the element and adhered to the black paper surface was visually rated on a 5-point scale. Higher points indicate less fall-off, with point 3 or lower indicating that fall-off fragments become a problem during the manufacturing and processing processes.

The test results of the recording element samples are shown in Tables 24 and 25. Table 24 shows the results of transparency and black pepper of samples A-101 to 105, 107 to 110, 112 to 115, 117 to 120, 122 to 125, 127 to 132. Table 25 shows the fall-off results of samples A-104 to 132.

TABLE 23

| Sample | Addition amount of conductive metal oxide particles (mg/m$^2$) | | Addition amount of matte agent (mg/m$^2$) | First layer | Second layer |
|---|---|---|---|---|---|
| No. | SN100F* | FS10D** | PMMA*** | (μm) | (μm) |
| A-101 | — | — | — | 0.15 | 0.05 |
| A-102 | 100 | — | — | 0.15 | 0.05 |
| A-103 | 200 | — | — | 0.15 | 0.05 |
| A-104 | — | 100 | — | 0.15 | 0.05 |
| A-105 | — | 200 | — | 0.15 | 0.05 |
| A-106 | — | — | 3.5 | 0.15 | 0.05 |
| A-107 | 100 | — | 3.5 | 0.15 | 0.05 |
| A-108 | 200 | — | 3.5 | 0.15 | 0.05 |
| A-109 | — | 100 | 3.5 | 0.15 | 0.05 |
| A-110 | — | 200 | 3.5 | 0.15 | 0.05 |
| A-111 | — | — | 3.5 | 0.35 | 0.05 |
| A-112 | 100 | — | 3.5 | 0.35 | 0.05 |
| A-113 | 200 | — | 3.5 | 0.35 | 0.05 |
| A-114 | — | 100 | 3.5 | 0.35 | 0.05 |
| A-115 | — | 200 | 3.5 | 0.35 | 0.05 |
| A-116 | — | — | 3.5 | 0.15 | 0.25 |
| A-117 | 100 | — | 3.5 | 0.15 | 0.25 |
| A-118 | 200 | — | 3.5 | 0.15 | 0.25 |

TABLE 23-continued

| Sample No. | Addition amount of conductive metal oxide particles ($mg/m^2$) SN100F* | FS10D** | Addition amount of matte agent ($mg/m^2$) PMMA*** | First layer ($\mu m$) | Second layer ($\mu m$) |
|---|---|---|---|---|---|
| A-119 | — | 100 | 3.5 | 0.15 | 0.25 |
| A-120 | — | 200 | 3.5 | 0.15 | 0.25 |
| A-121 | — | — | 7 | 0.15 | 0.25 |
| A-122 | 100 | — | 7 | 0.15 | 0.25 |
| A-123 | 200 | — | 7 | 0.15 | 0.25 |
| A-124 | — | 100 | 7 | 0.15 | 0.25 |
| A-125 | — | 200 | 7 | 0.15 | 0.25 |
| A-126 | — | — | 7 | 0.15 | 0.5 |
| A-127 | 100 | — | 7 | 0.15 | 0.5 |
| A-128 | 200 | — | 7 | 0.15 | 0.5 |
| A-129 | — | 100 | 7 | 0.15 | 0.5 |
| A-130 | — | 200 | 7 | 0.15 | 0.5 |
| A-131 | — | — | 7 | 0.4 | — |
| A-132 | — | — | 7 | 0.65 | — |

*SN-100F: a dispersion in water of Sb-doped $SnO_2$ (spherical particles, mean particle size 0.1 $\mu m$)
**FS-10D: a dispersion in water of Sb-doped $SnO_2$ (acicular particles, length/breadth: 20~30, length: 0.2~2.0 $\mu m$, breadth: 0.01~0.02 $\mu m$)
SN-100F and FS-10D both commercially available from Ishihara Industry K.K.
***PMMA: polymethyl methacrylate (mean particle size 5 $\mu m$)

TABLE 24

| Sample No. | Transparency | Black pepper by static electricity | Remarks |
|---|---|---|---|
| A-101 | 5 | 1 | Comparison |
| A-102 | 3 | 3 | Comparison |
| A-103 | 2 | 4 | Comparison |
| A-104 | 5 | 4 | Invention |
| A-105 | 5 | 5 | Invention |
| A-107 | 3 | 3 | Comparison |
| A-108 | 2 | 4 | Comparison |
| A-109 | 5 | 4 | Invention |
| A-110 | 5 | 5 | Invention |
| A-112 | 3 | 3 | Comparison |
| A-113 | 2 | 4 | Comparison |
| A-114 | 5 | 4 | Invention |
| A-115 | 5 | 5 | Invention |
| A-117 | 3 | 3 | Comparison |
| A-118 | 2 | 4 | Comparison |
| A-119 | 5 | 4 | Invention |
| A-120 | 5 | 5 | Invention |
| A-122 | 3 | 3 | Comparison |
| A-123 | 2 | 4 | Comparison |
| A-124 | 5 | 4 | Invention |
| A-125 | 5 | 5 | Invention |
| A-127 | 3 | 3 | Comparison |
| A-128 | 2 | 4 | Comparison |
| A-129 | 5 | 4 | Invention |
| A-130 | 5 | 5 | Invention |
| A-131 | 5 | 1 | Comparison |
| A-132 | 5 | 1 | Comparison |

TABLE 25

| Sample No. | Fall-off | Remarks |
|---|---|---|
| A-104 | 5 | Invention |
| A-105 | 5 | Invention |
| A-106 | 4 | Invention |
| A-107 | 4 | Invention |
| A-108 | 3 | Invention |
| A-109 | 4 | Invention |
| A-110 | 4 | Invention |
| A-111 | 4 | Invention |

TABLE 25-continued

| Sample No. | Fall-off | Remarks |
|---|---|---|
| A-112 | 4 | Invention |
| A-113 | 3 | Invention |
| A-114 | 4 | Invention |
| A-115 | 4 | Invention |
| A-116 | 5 | Invention |
| A-117 | 5 | Invention |
| A-118 | 5 | Invention |
| A-119 | 5 | Invention |
| A-120 | 5 | Invention |
| A-121 | 5 | Invention |
| A-122 | 5 | Invention |
| A-123 | 5 | Invention |
| A-124 | 5 | Invention |
| A-125 | 5 | Invention |
| A-126 | 5 | Invention |
| A-127 | 5 | Invention |
| A-128 | 5 | Invention |
| A-129 | 5 | Invention |
| A-130 | 5 | Invention |
| A-131 | 2 | Comparison |
| A-132 | 3 | Comparison |

It is seen from the above results that transparency is significantly improved by changing spherical fine particles to acicular fine particles. Spherical fine particles are inferior in transparency to acicular fine particles even when the amount of particles added is reduced. With respect to the effect of suppressing the development of black peppers by static electricity, spherical fine particles become more effective with increasing addition amount, but to a less extent than an identical amount of acicular fine particles added. It is difficult for spherical fine particles to find a compromise between transparency and black pepper suppression.

The effect of preventing fragments from falling off is enhanced by increasing the thickness of only the first layer, but to a less satisfactory level. The provision of two back layers is quite effective in this respect. With respect to the film thickness, the second layer as thin as 0.05 $\mu m$ can achieve just the marginally acceptable fall-off preventing effect. Increasing the thickness of the second layer to 0.25 $\mu m$ ensures that the fragment fall-off preventing effect is maintained even when the amount of matte agent is increased.

Example 2

Back-coated samples BC-B 101 to 132 were prepared as in Example 1 and heat treated as in Example 1. The image recording layer described in EP 0762196, pages 50–51, was formed thereon as a thermographic recording layer. These samples were subject to the same tests as in Example 1. The results were equivalent to those of Example 1.

There has been described a thermographic recording element comprising a thermographic recording layer on a support. In one embodiment, the element has an antistatic layer containing acicular conductive metal oxide particles having a specific aspect ratio. In another embodiment, the element has at least two back layers, the outermost layer of which contains a hydrophobic polymer binder and another layer of which contains a matte agent. The element is improved in transparency and conductivity, or effective for preventing fragments from falling off.

Japanese patent application no. 041302/1998 is incorporated herein by reference.

Reasonable modifications and variations are possible from the foregoing disclosure without departing from either the spirit or scope of the present invention as defined by the claims.

What is claimed is:

1. A thermographic recording element comprising:

a support having a pair of opposed surfaces, at least one antistatic layer containing conductive metal oxide particles and at least one thermographic recording layer containing an organic silver salt and a reducing agent on the first surface of the support, and at least two layers on the other surface of the support, wherein the outermost layer of said at least two layers contains a hydrophobic polymer binder and at least one layer of said at least two layers other than said outermost layer contains a matte agent, wherein:

said conductive metal oxide particles are acicular particles having a major axis to minor axis ratio of from 3/1 to 50/1, and said thermographic recording element further comprises a nucleating agent.

2. The thermographic recording element of claim 1 wherein said conductive metal oxide particles are at least one of the particles selected from the group consisting of ZnO, $TiO_2$, $SnO_2$, $Al_2O_3$, $In_2O_3$, MgO, and compound oxides thereof, which may further contain a hetero atom wherein:

if the metal oxide particles are ZnO, said hetero atom is Al or In, if the metal oxide particles are $TiO_2$, said hetero atom is Nb or Ta, if the metal oxide particles are $In_2O_3$, the hetero atom is Sn, and if the metal oxide particles are $SnO_2$, the hetero atom is Sb, Nb or halogen atom.

3. The thermographic recording element of claim 2 wherein said conductive metal oxide particles are particles of $SnO_2$ doped with antimony.

4. The thermographic recording element of claim 2 wherein said metal oxide is doped with 0.01 to 30 mol % of said heteroatom.

5. The thermographic recording element of claim 2 wherein said metal oxide is doped with 0.1 to 10 mol % of said heteroatom.

6. The thermographic recording element of claim 2 wherein said conductive metal oxide particles are $SnO_2$ particles doped with 0.2 to 2.0 mol % of antimony.

7. The thermographic recording element of claim 1 wherein the outermost layer is based on a binder containing at least 75% by weight of a water-dispersible polymer latex.

8. The thermographic recording element of claim 1 wherein the outermost layer has a thickness of 0.2 to 10 $\mu$m.

9. The thermographic recording element of claim 1 wherein the major axis to minor axis ratio of said conductive metal oxide particles is from 10/1 to 50/1.

10. The thermographic recording element of claim 1 wherein the minor axis of said conductive metal oxide particles is 0.001 to 0.1 $\mu$m.

11. The thermographic recording element of claim 1 wherein the minor axis of said conductive metal oxide particles is 0.01 to 0.02 $\mu$m.

12. The thermographic recording element of claim 1 wherein the major axis of said conductive metal oxide particles is 0.1 to 5.0 $\mu$m.

13. The thermographic recording element of claim 1 wherein the major axis of said conductive metal oxide particles is 0.1 to 2.0 $\mu$m.

14. A thermographic recording element comprising a support having a pair of opposed surfaces, at least one thermographic recording layer containing an organic silver salt and a reducing agent on one surface of the support, and at least two layers on the other surface of the support, wherein the outermost layer of said at least two layers contains a hydrophobic polymer binder and at least one layer of said at least two layers other than said outermost layer contains a matte agent.

15. The thermographic recording element of claim 14 wherein the outermost layer is based on a binder containing at least 75% by weight of a water-dispersible polymer latex.

16. The thermographic recording element of claim 14 wherein the outermost layer has a thickness of 0.2 to 10 $\mu$m.

* * * * *